US009400447B2

(12) United States Patent
Kobayashi

(10) Patent No.: US 9,400,447 B2
(45) Date of Patent: Jul. 26, 2016

(54) IMAGE FORMING APPARATUS

(71) Applicant: CANON KABUSHIKI KAISHA, Tokyo (JP)

(72) Inventor: Shinsuke Kobayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/885,367

(22) Filed: Oct. 16, 2015

(65) Prior Publication Data

US 2016/0116859 A1 Apr. 28, 2016

(30) Foreign Application Priority Data

Oct. 22, 2014 (JP) ..... 2014-215173
Oct. 5, 2015 (JP) ..... 2015-197806

(51) Int. Cl.
*G03G 15/08* (2006.01)
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS

2005/0260007 A1* 11/2005 Shimomura ..... G03G 15/065 399/55
2006/0008300 A1* 1/2006 Tanaka ..... G03G 15/065 399/269
2010/0303488 A1* 12/2010 Yanagi ..... G03G 15/065 399/45
2012/0003016 A1* 1/2012 Uchiyama ..... G03G 15/0131 399/301
2012/0027437 A1* 2/2012 Maruyama ..... G03G 15/0194 399/31
2013/0004204 A1* 1/2013 Hagiwara ..... G03G 15/043 399/128
2013/0141511 A1* 6/2013 Hasegawa ..... G03G 15/043 347/224
2013/0195518 A1* 8/2013 Kumada ..... G03G 15/0131 399/301
2014/0016952 A1* 1/2014 Matsuda ..... G03G 15/75 399/26
2014/0056624 A1* 2/2014 Naruge ..... G03G 15/043 399/301
2014/0079429 A1* 3/2014 Hamaya ..... G03G 15/80 399/88
2014/0153946 A1* 6/2014 Kobayashi ..... G03G 15/1605 399/66
2014/0363211 A1* 12/2014 Sugiyama ..... G03G 15/5058 399/301
2015/0063834 A1* 3/2015 Kobayashi ..... G03G 15/043 399/12
2016/0048091 A1* 2/2016 Ishii ..... G03G 15/065 399/50

FOREIGN PATENT DOCUMENTS

JP 2012-032777 A 2/2012
JP 2013-33231 A 2/2013
JP 2013-156549 A 8/2013
JP 2013-182011 A 9/2013
JP 2014-60898 A 4/2014
JP 2014-115346 A 6/2014

* cited by examiner

*Primary Examiner* — David Bolduc
(74) *Attorney, Agent, or Firm* — Canon U.S.A., Inc., IP Division

(57) ABSTRACT

An image forming apparatus includes a first power source configured to supply charging voltage to a first charging unit, and a second power source configured to supply predetermined voltage to at least one of a second charging unit, a second developing member, and a second transfer unit. The first and the second power sources are grounded via a common resistor component. When the second power source in a state of supplying no voltage or supplying voltage lower than the predetermined voltage at a first timing starts supplying the predetermined voltage while the first power source is supplying the charging voltage, a control unit causes a separating mechanism to move a first developing member to a separation position before a second timing at which an area of a first photosensitive member that is at a charging position at the first timing reaches a developing position.

20 Claims, 12 Drawing Sheets

IMAGE FORMING APPARATUS

BACKGROUND OF THE INVENTION

1. Field of the Invention

The present invention relates to an image forming apparatus employing an electrophotographic recording method such as a laser printer, a copying machine, and a facsimile device.

2. Description of the Related Art

As a conventional electrophotographic image forming apparatus, a color image forming apparatus employing an inline method, in which image forming units of respective colors are arranged side by side, is known. In this color image forming apparatus, a plurality of image forming units is arranged side by side. Each of the image forming units includes an electrophotographic photosensitive member (hereinafter, referred to as a photosensitive drum) and process units that work on the photosensitive drum, such as a charging unit, a developing member, and a cleaning unit. Images are sequentially transferred onto an intermediate transfer belt or a transfer material or the like on a conveyer belt facing the plurality of image forming units.

In such a color image forming apparatus, color shift may occur when the images overlap with each other due to a difference in mechanical accuracy and the like among the image forming units corresponding to respective colors (for example, yellow (Y), magenta (M), cyan (C), and black (K)). In particular, in a configuration in which a laser scanner and the photosensitive drum are independently provided for each of the image forming units corresponding to respective colors, the positional relationship between the laser scanner and the photosensitive drum differs for each color. Thus, the color shift occurs due to a failure to synchronize laser scanned positions on the photosensitive drums.

In view of the above, color shift correction control is performed in the color image forming apparatus to correct the color shift. Japanese Patent Application Laid-Open No. 2012-032777 discusses a circuit configuration of accurately correcting the color shift occurring when images of a plurality of colors overlap with each other. More specifically, a common current detection circuit is provided for independent high voltage power sources that supply current to the image forming units corresponding to the respective colors.

However, in the circuit configuration discussed in Japanese Patent Application Laid-Open No. 2012-032777, the independent high voltage power sources, connected to each other via a common current detection circuit, may affect each other to cause an image failure.

More specifically, when a second independent high voltage power source is turned on while a first independent high voltage power source is in an ON state, charge current generated in a second high voltage power source circuit instantaneously flows into the current detection circuit, and thus a potential between input and output terminals changes due to a resistor component in the current detection circuit. The potential change affects a first high voltage power source circuit, and thus a value of voltage output from the first high voltage power source circuit changes.

Thus, charging voltage for the color K changes when a mode is switched to a full color mode when successive printing in a monochrome mode is in process, for example. More specifically, when charging voltage for the colors Y, M, and C is applied while the charging voltage for the color K is being applied, charge current supplied to power source circuits for the colors Y, M, and C instantaneously flows into the current detection circuit to change the charging voltage for the color K. As a result, an image failure such as a traverse line occurs in an image due to transfer of toner onto a portion of the photosensitive drum for the color K where a charging output is small.

Such a problem occurs not only in the circuit configuration in which the independent high voltage power sources are connected to each other via the common current detection circuit, but also in any circuit configuration in which independent high voltage power sources are grounded via a common resistor component. Furthermore, the problem may also occur in a configuration in which independent high voltage power sources are arranged on a common substrate that is not grounded to a frame ground (a casing) of an apparatus main body.

SUMMARY OF THE INVENTION

The present invention is directed to an image forming apparatus capable of suppressing, in a configuration in which a plurality of independent high voltage power sources is connected to each other via a common current detection circuit, an image failure caused by the independent high voltage power sources affecting each other.

According to an aspect of the present invention, an image forming apparatus including first and second photosensitive members configured to be rotatably driven, first and second charging units configured to respectively charge the first and the second photosensitive members at respective charging positions, first and second developing members configured to cause toner to attach to the first and the second photosensitive members at respective developing positions, first and second transfer units configured to transfer toner images formed on the first and the second photosensitive members onto a transfer target, a first power source configured to supply charging voltage to the first charging unit, a second power source configured to supply predetermined voltage to at least one of the second charging unit, the second developing member, and the second transfer unit, a separating mechanism configured to move the first developing member from a contact position where the first developing member is in contact with the first photosensitive member at the developing position to a separation position where the first developing member is separated from the first photosensitive member, and a control unit configured to control the separating mechanism, wherein the first and the second power sources are grounded via a common resistor component, and wherein when the second power source in a state of supplying no voltage or supplying voltage lower than the predetermined voltage at a first timing starts supplying the predetermined voltage while the first power source is supplying the charging voltage, the control unit causes the separating mechanism to move the first developing member to the separation position before a second timing at which an area of the first photosensitive member that is at the charging position at the first timing reaches the developing position.

Further features of the present invention will become apparent from the following description of exemplary embodiments with reference to the attached drawings.

DESCRIPTION OF THE EMBODIMENTS

Exemplary embodiments of the present invention are described below in detail with reference to the drawings. The size, the material, the shape, and the relative arrangement of components described in the exemplary embodiments are appropriately changed in accordance with a configuration of an apparatus to which the present invention is applied and various conditions. Thus, the scope of the present invention is not limited thereto unless otherwise specifically noted.

<Image Forming Apparatus>

Figure 1:
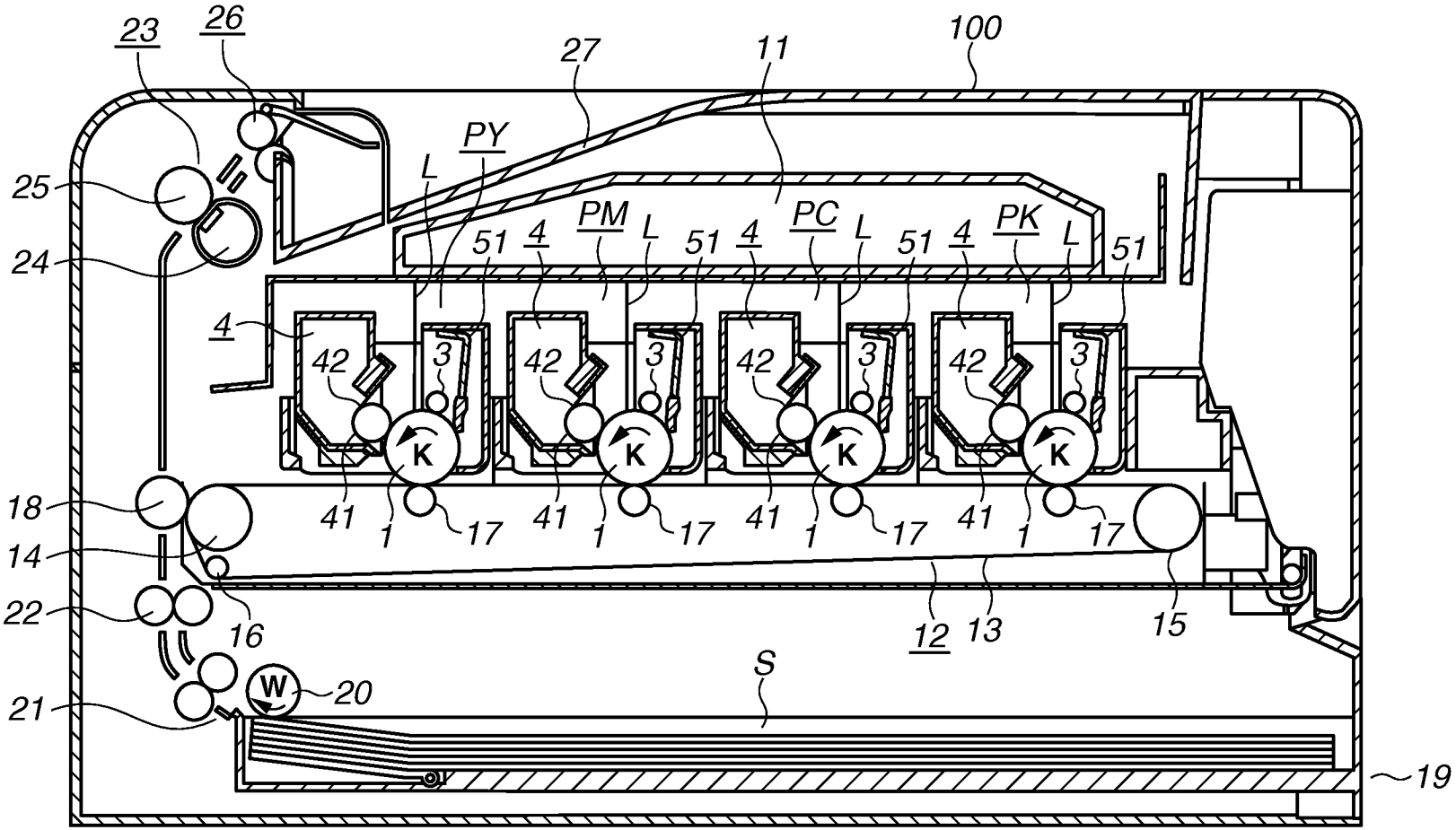
FIG. 1 is a diagram illustrating an image forming apparatus according to a first exemplary embodiment.

FIG. 1 is a schematic diagram illustrating a configuration of a color image forming apparatus 100 according to a first exemplary embodiment of the present invention.

The image forming apparatus 100 includes a laser scanner 11, an intermediate transfer belt 13, a fixing film 24, a pressing roller 25, a sheet feed tray 19, a sheet feeding roller 20, and the like.

The image forming apparatus 100 further includes four process cartridges P (PY, PM, PC, and PK),i.e., a first process cartridge PY, a second process cartridge PM, a third process cartridge PC, and a fourth process cartridge PK, arranged in a horizontal direction. The first to the fourth process cartridges P (PY, PM, PC, and PK) include similar electrophotographic image forming process mechanisms which are different from each other only in the color of developer.

The number of process cartridges as a plurality of image forming units, detachably attached to the image forming apparatus 100, which is four in this example, is not particularly limited and is set as appropriate.

The first to the fourth process cartridges P (PY, PM, PC, and PK) each include a developing unit 4 including a developing roller 41 with which an electrostatic latent image, on a photosensitive drum 1 serving as an image bearing member, is developed.

The first process cartridge PY includes the developing unit 4 accommodating yellow (Y) developer, and forms a yellow developer image on a surface of the photosensitive drum 1.

The second process cartridge PM includes the developing unit 4 accommodating magenta (M) developer, and forms a magenta developer image on a surface of the photosensitive drum 1.

The third process cartridge PC includes the developing unit 4 accommodating cyan (C) developer, and forms a cyan developer image on a surface of the photosensitive drum 1.

The fourth process cartridge PK includes the developing unit 4 accommodating black (K) developer, and forms a black developer image on a surface of the photosensitive drum 1.

Recording media S, stacked and accommodated in the sheet feed tray 19, are picked up by the sheet feeding roller 20, rotating in the clockwise direction in FIG. 1 (a direction indicated by an arrow W), and are fed to a contact portion (hereinafter, referred to as a "nip portion") between a belt driving roller 14 and a secondary transfer roller 18.

The photosensitive drum 1 rotates in the counterclockwise direction in FIG. 1 (a direction indicated by an arrow K). Electrostatic latent images are sequentially formed on an outer circumference surface of the photosensitive drum 1 at an exposing position with a laser beam L from the laser scanner (exposure unit) 11. Then, the electrostatic latent image is developed (toner is attached) by the developing roller 41 serving as a developing member at a developing position, whereby a toner image (developer image) is formed on the photosensitive drum 1. The developing position is a position at which the developing roller 41 causes the toner to attach to the photosensitive drum 1, and is a position where the photosensitive drum 1 and the developing roller 41 face each other.

The toner image formed on the photosensitive drum is transferred onto the intermediate transfer belt (transfer target member) 13 by a primary transfer roller 17. The primary transfer roller 17 is a transfer unit that faces the photosensitive drum 1 at a transferring position across the intermediate transfer belt 13 serving as an intermediate transferring member disposed therebetween. When a color image is formed, each electrostatic latent image on the photosensitive drums 1 is developed with yellow (Y) toner, magenta (M) toner, cyan (C) toner, and black (K) toner. Then, the resultant toner images are sequentially transferred onto the intermediate transfer belt 13. The transferring position is a position at which the toner image formed on the photosensitive drum 1 is transferred onto the intermediate transfer belt 13, and is a position where the photosensitive drum 1 and the primary transfer roller 17 face each other with the intermediate transfer belt 13 disposed therebetween.

Then, the toner image thus formed on the intermediate transfer belt 13 is transferred onto the recording medium S fed to the contact nip portion between the belt driving roller 14 and the secondary transfer roller 18.

The recording medium S, onto which the toner image has been transferred, is sent to a contact nip portion between the fixing film 24 and the pressing roller 25. The toner image is heated and pressed at the contact nip portion to be fixed on the recording medium S. The recording medium S on which the toner image has been fixed is discharged onto an output tray 27 by a pair of discharge rollers 26.

<Configuration of Process Cartridge>

Figure 2:
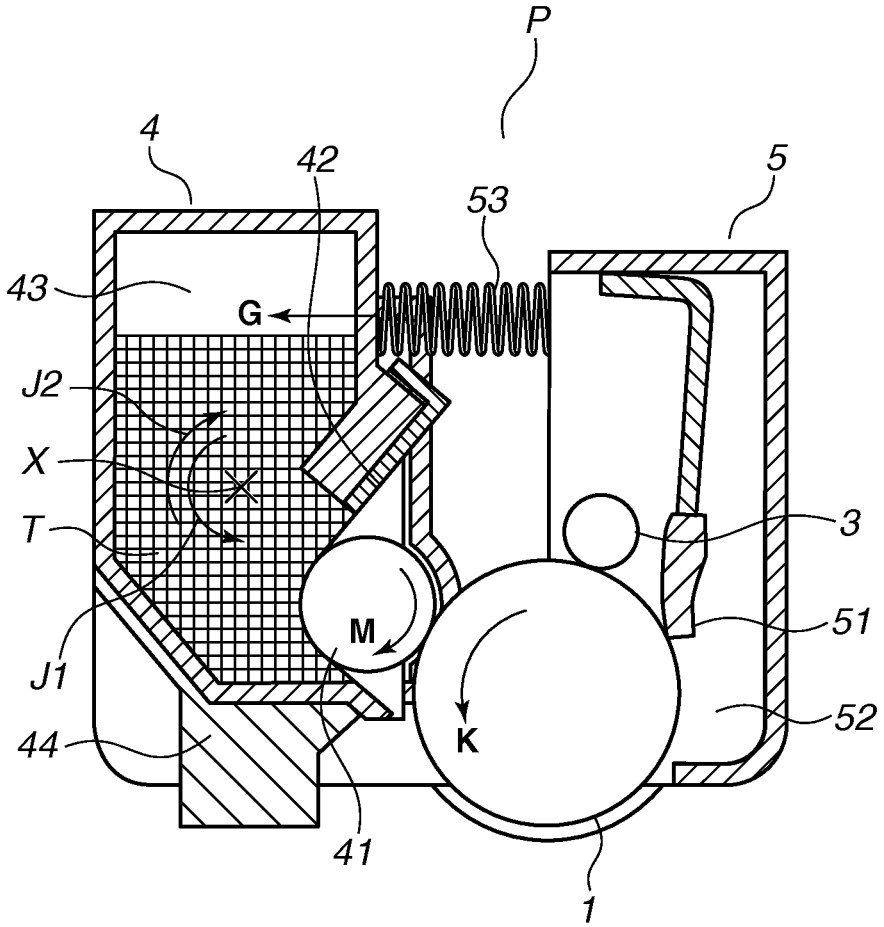
FIG. 2 is a cross-sectional view of a process cartridge according to the first exemplary embodiment.

FIG. 2 is a cross-sectional view of the process cartridge P taken along a direction orthogonal to an axial direction of the photosensitive drum 1. In FIG. 2, the photosensitive drum 1 and the developing roller 41 are rotatably driven at a predetermined speed by a driving source (not illustrated), in the counterclockwise direction (the direction indicated by the arrow K) and in the clockwise direction (the direction indicated by the arrow M), respectively.

In the present exemplary embodiment, the process cartridge P includes a cleaner unit 5 and the developing unit 4 rotatably coupled to the cleaner unit 5. The cleaner unit 5 is a first unit (photosensitive drum unit) that holds the photosensitive drum 1, and the developing unit 4 is a second unit that holds the developing roller 41.

A charging roller (charging unit) 3 disposed in the cleaner unit 5, is a charging unit employing a contact charging method. The charging roller 3 thus comes into contact with the photosensitive drum 1 at a charging position to be rotated along with the rotation of the photosensitive drum 1. A cleaning blade (cleaning unit) 51 is disposed with its distal end portion in contact with the photosensitive drum 1. The cleaning blade 51 removes toner remaining on the photosensitive drum 1. The residual toner removed by the cleaning blade 51 is stored in a toner accommodation section 52 in the cleaner unit 5.

The developing unit 4 includes the developing roller 41 as the developing member, and a developing blade 42. The developing unit 4 further includes a developing chamber (developer accommodation section) 43 accommodating toner. The developing roller 41 is disposed in the developing chamber 43, and the developing blade 42 is disposed with its distal end in contact with the developing roller 41. The developing blade 42 regulates a toner layer on a circumference surface of the developing roller 41 to be a thin layer.

The developing unit 4 is pressed by a pressing spring 53 that is an elastic member and rotates about a rotational center X of the developing unit 4 so that the developing roller 41 comes into contact with the photosensitive drum 1. More specifically, the developing unit 4 is pressed by the pressing force of the pressing spring 53 in a direction indicated by an arrow G illustrated in FIG. 2, whereby a moment is applied in a direction indicated by an arrow J1 around the rotational center X. Thus, the developing roller 41 can come into contact with the photosensitive drum 1 with a predetermined pressure. The position of the developing roller 41 of the developing unit 4 at this time is referred to as a contact position.

In the image forming apparatus 100, the developing roller 41 and the photosensitive drum 1 are separated from each other when image forming is not performed (in a standby state). The position of the developing roller 41 of the developing unit 4 at this time is referred to as a separation position. The developing roller 41 is held at the separation position as described above so as to suppress denting on the developing roller 41 which occurs when the developing roller 41 is in contact with the photosensitive drum 1 for a long period of time, and image failure accompanying the occurrence of the denting. A protruding member 44 is a member that causes the developing roller 41 and the photosensitive drum 1 to separate from each other and is disposed at an end portion of the developing unit 4 in the axial direction (longitudinal direction) of the developing unit 4. A developing roller separating mechanism 60 with which the developing roller 41 and the photosensitive drum 1 are separated from each other is described below in detail.

<Developing Roller Separating Mechanism/Operation>

FIG. 3 is a cross-sectional view illustrating a relationship between the process cartridges P and the developing roller separating mechanism 60 including moving members 62*x* and 62*y* disposed below the process cartridges P (PY, PM, PC, and PK). The process cartridges PY, PM, and PC can individually move in directions indicated by arrows M and N in conjunction with an operation of the moving member 62*x*, and the process cartridge PK can move in the directions indicated by the arrows M and N in conjunction with an operation of the moving member 62*y*.

Circular cams 64*x* and 64*y* are respectively coupled to the moving members 62*x* and 62*y*. Further, cam driving shafts 65*x* and 65*y* at positions separate from the center of the cams 64*x* and 64*y* are respectively coupled to the moving members 62*x* and 62*y*. The cams 64*x* and 64*y* respectively rotate about the cam driving shafts 65*x* and 65*y* while receiving driving force from a driving source (not illustrated) provided in the image forming apparatus 100, whereby the moving members 62*x* and 62*y* move in a substantially horizontal direction (directions indicated by the arrows M and N).

Through the rotations of the cams 64*x* and 64*y*, the moving members 62*x* and 62*y* move to enter any one of three contact/separated states including a "standby state" (see FIG. 3A), a "full color image forming state" (see FIG. 3B), and a "monochrome color image forming state" (see FIG. 3C) described below. More specifically, through the rotations of the cams 64*x* and 64*y*, the moving members 62*x* and 62*y* move to enter the "standby state" (see FIG. 3A) in which with respect to all of the process cartridges PY, PM, PC, and PK, the developing rollers 41 are separated from the photosensitive drums 1. Through the rotations of the cams 64*x* and 64*y*, the moving members 62*x* and 62*y* move to enter the "full color image forming state" (see FIG. 3B) in which the developing rollers 41 of all of the process cartridges PY, PM, PC, and PK are in contact with the respective photosensitive drums 1. Through the rotations of the cams 64*x* and 64*y*, the moving members 62*x* and 62*y* move to enter the "monochrome image forming state" (see FIG. 3C) in which the developing roller 41 of only the process cartridge PK is in contact with the photosensitive drum 1.

Figure 3A:
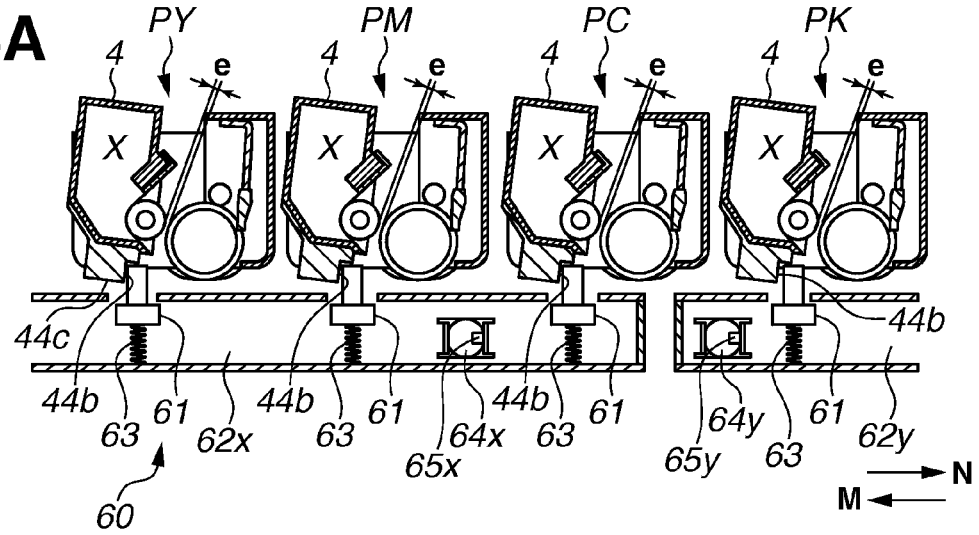
FIGS. 3A, 3B, and 3C are each a diagram illustrating a developing roller contact/separation state in the process cartridge according to the first exemplary embodiment.

As described above, in the image forming apparatus 100, the developing rollers 41 and the photosensitive drums 1 are separated from each other as illustrated in FIG. 3A (in the "standby state") when the image forming is not performed. Here, the protruding members 44 of all of the process cartridges PY, PM, PC, and PK receive pressing forces in a direction indicated by the arrow M illustrated in FIG. 3A from separating members 61 of the developing roller separating mechanism 60. Thus, the developing unit 4 of each process cartridge P rotates about the rotational center X, whereby the developing roller 41 and the photosensitive drum 1 are separated from each other.

Figure 3B:
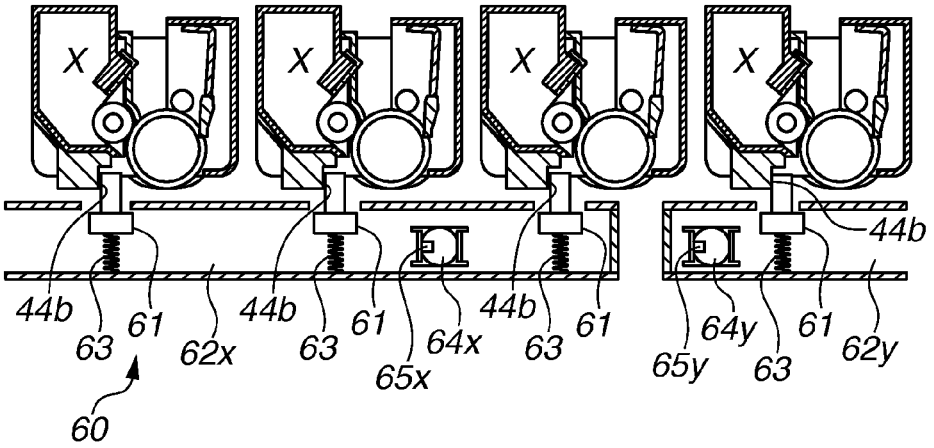

Then, when the developing roller separating mechanism 60 is operated for a single time, the image forming apparatus 100 transitions from the "standby state" to the "full color image forming state" (see FIG. 3B). More specifically, the moving member 62*x* and the moving member 62*y* both move in the direction indicated by the arrow N in FIG. 3A, whereby the protruding members 44 of all of the process cartridges PY, PM, PC, and PK no longer receive the pressing forces of the separating members 61. Thus, the developing rollers 41 in all the process cartridges PY, PM, PC, and PK are moved to the contact positions from the separation positions by the forces of the pressing springs 53, and thus come into contact with the photosensitive drums 1. As a result, the developing rollers 41 and the photosensitive drums 1 of all of the process cartridges PY, PM, PC, and PK are in contact with each other, and thus full color image forming can be performed.

Figure 3C:
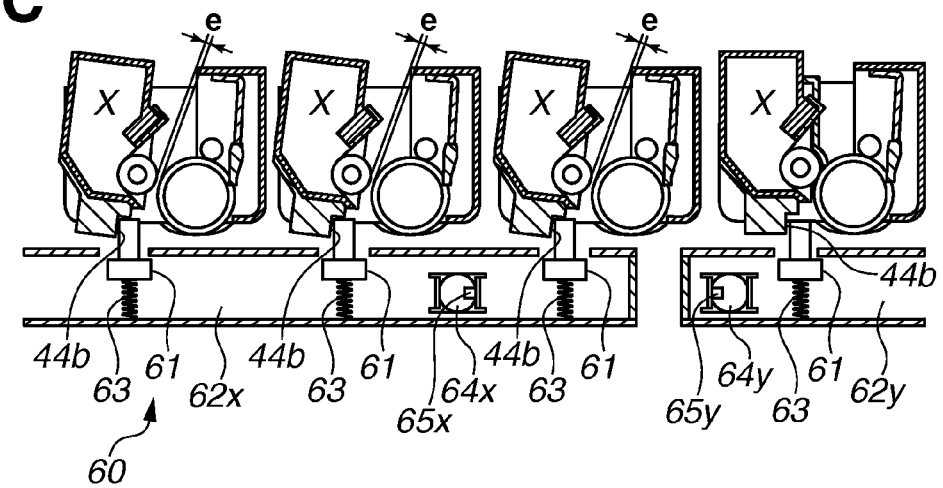

When the developing roller separating mechanism 60 is further operated for a single time, the image forming apparatus 100 transitions from the "full color image forming state" to the "monochrome color image forming state" (see FIG. 3C). More specifically, only the moving member 62*x* moves in the direction indicated by the arrow M in FIG. 3A, whereby the protruding members 44 in the process cartridges PY, PM, and PC receive the pressing forces in the direction indicated by the arrow M in FIG. 3A from the separating members 61 of the developing roller separating mechanism 60. Thus, the developing units 4 of the process cartridges PY, PM, and PC rotate about the rotational center X, whereby the developing rollers 41 and the photosensitive drums 1 are separated from each other. On the other hand, the process cartridge PK stays in the state where the developing roller 41 and the photosensitive drum 1 are in contact with each other. In this state, the full color image forming cannot be performed, and only monochrome image forming can be performed.

When the developing roller separating mechanism 60 is further operated for a single time, the image forming apparatus 100 transitions from the "monochrome color image forming state" to the "standby state" (see FIG. 3A) again. More specifically, when only the moving member 62*y* is moved in the direction indicated by the arrow M in FIG. 3A, the protruding member 44 of the process cartridge PK receives the pressing force in the direction indicated by the arrow M in FIG. 3A from the separating member 61 of the developing roller separating mechanism 60. Thus, the developing unit 4 of the process cartridge PK rotates about the rotational center X, whereby the developing roller 41 and the photosensitive drum 1 are separated from each other. As a result, the developing rollers 41 in all of the process cartridges PY, PM, PC, and PK are separated from the photosensitive drums 1.

As described above, through the operation of the developing roller separating mechanism 60, the state of the image forming apparatus 100 repeatedly transitions in the following sequence, i.e., from the "standby state" to the "full color image forming state", from the "full color image forming state" to the "monochrome color image forming state", and from the "monochrome color image forming state" to the "standby state".

<Configuration of High Voltage Power Source Device>

Next, a configuration of a high voltage power source device in the image forming apparatus 100 illustrated in FIG. 1 will be described with reference to FIG. 4. The high voltage power source device includes a charging high voltage power source circuit 33*b* as a first power source that supplies voltage (charging voltage) to a charging roller 3K of the process cartridge PK. The high voltage power source device further includes a charging high voltage power source circuit 33*a* as a second power source that supplies voltage (charging voltage) to charging rollers 3Y, 3M, and 3C of the respective process cartridges PY, PM, and PC. The high voltage power source device further includes developing high voltage power source circuits 34Y, 34M, 34C, and 34K, a primary transfer high voltage power source circuit 36, and a secondary transfer high voltage power source circuit 38. The charging high voltage power source circuit 33*b* applies predetermined voltage to the charging roller 3K, and the charging high voltage power source circuit 33*a* applies predetermined voltage to each of the charging rollers 3Y, 3M, and 3C and not to the charging roller 3K. Thus, a background potential portion is formed on the surfaces of photosensitive drums 1Y, 1M, 1C, and 1K at the charging positions, so that images as an electrostatic latent image potential portion can be formed when the background potential portion is irradiated with the laser beam L.

The developing high voltage power source circuits 34Y, 34M, 34C, and 34K respectively apply predetermined voltage to developing rollers 41Y, 41M, 41C, and 41K. Thus, the toner attaches to the electrostatic latent image potential portions of the photosensitive drums 1Y, 1M, 1C, and 1K, whereby the toner images are formed. The primary transfer high voltage power source circuit 36 applies predetermined voltage to each of primary transfer rollers 17Y, 17M, 17C, and 17K, so that the toner images on the photosensitive drums 1Y, 1M, 1C, and 1K are transferred onto the intermediate transfer belt 13. A charging unit (charging roller 3K) that performs the charging with the voltage supplied from the first power source (high voltage charging power source circuit 33*b*) is referred to as a first charging unit. A photosensitive member (photosensitive drum 1K) charged by the first charging unit is referred to as a first photosensitive member. A developing member (developing roller 41K) that causes the toner to attach to the first photosensitive member is referred to as a first developing member. A transfer unit (primary transfer roller 17K) that transfers the toner image from the first photosensitive member is referred to as a first transfer unit. Charging units (charging rollers 3Y, 3M, and 3C) that perform the charging with the voltage supplied from the second power source (high voltage charging power source circuit 33*a*) are each referred to as a second charging unit. Photosensitive members (photosensitive drums 1Y, 1M, and 1C) charged by the second charging unit are each referred to as a second photosensitive member. Developing members (developing rollers 41Y, 41M, and 41C) that cause the toner to attach to the second photosensitive members are each referred to as a second developing member. Transfer units (primary transfer rollers 17Y, 17M, and 17C) that transfer the toner image from the second photosensitive member are each referred to as a second transfer unit.

The secondary transfer high voltage power source circuit 38 applies (supplies) secondary transfer voltage to the secondary transfer roller 18 as a third transfer unit so that the toner image on the intermediate transfer belt 13 is transferred onto the recording medium S.

The charging high voltage power source circuit 33*a* and the high voltage charging power source circuit 33*b* are connected to each other via a current detection circuit serving as a common resistor component, whereby color shift of the process cartridges P (PY, PM, PC, and PK) is suppressed. More specifically, the surface of the photosensitive drum 1 (Y, M, C, and K), uniformly charged as background potential, is irradiated with the laser beam L in a state where the developing roller 41 (Y, M, C, and K) is separated from the photosensitive drum 1 (Y, M, C, and K) in the process cartridge P corresponding to each color. A value of current flowing from the charging roller (Y, M, C, and K) to the current detection circuit 37 is different between a state where the surface of the photosensitive drum 1 (Y, M, C, and K) is at the background potential and a state where the surface of the photosensitive drum 1 (Y, M, C, and K) is at the electrostatic latent image potential. Thus, by measuring a time period between a laser irradiating timing and a timing at which the electrostatic latent image potential portion irradiated with the laser beam L reaches the charging roller 3 (Y, M, C, and K) the laser irradiating timing for the process cartridge of each color is adjusted, whereby the color shift is suppressed.

<High Voltage Power Source Circuit>

Figure 4:
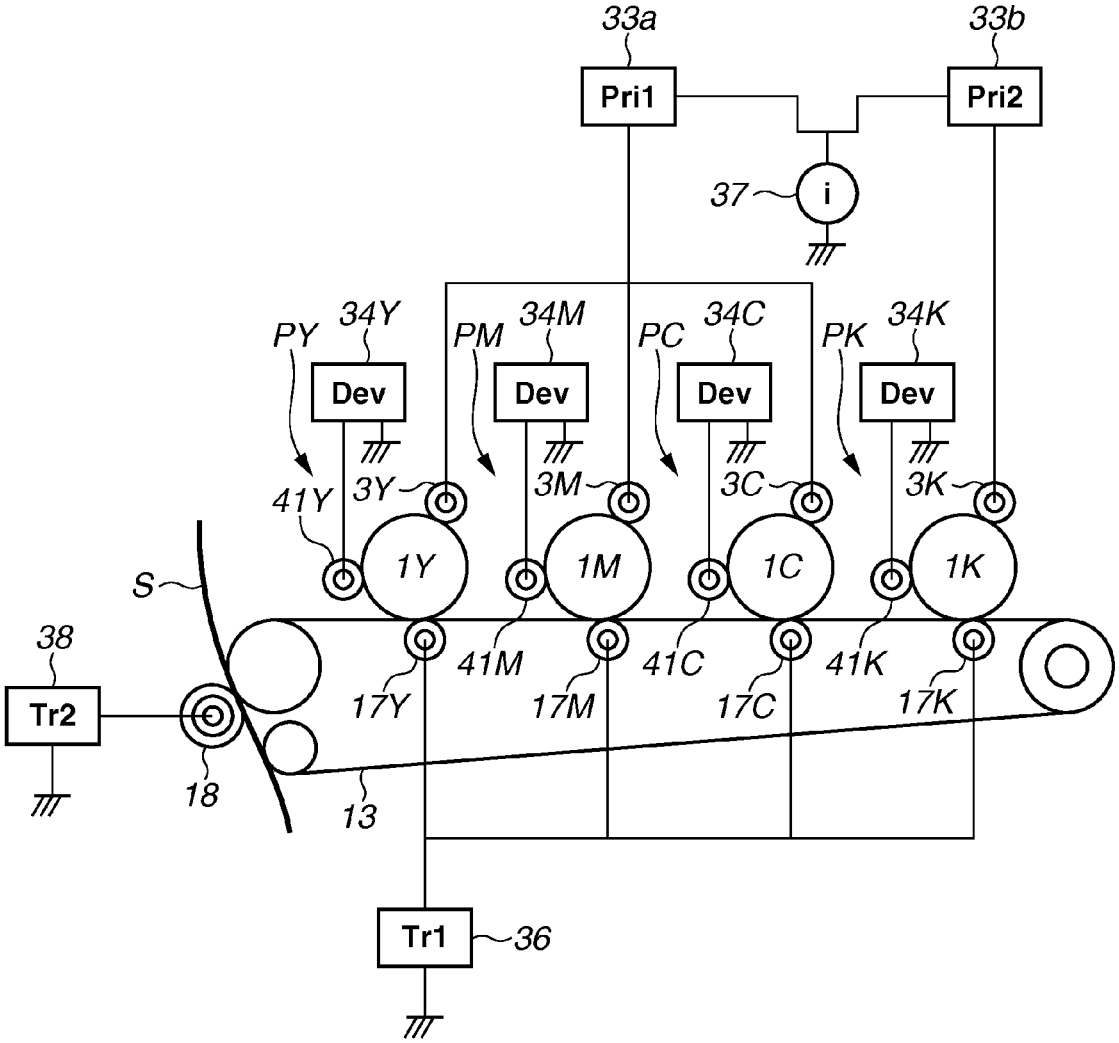
FIG. 4 is a diagram illustrating a configuration of a high voltage power source device according to the first exemplary embodiment.

Next, the high voltage charging power source circuits 33*a* and 33*b*, and the current detection circuit 37 in the high voltage power source device illustrated in FIG. 4 are described with reference to FIG. 5.

Figure 5:
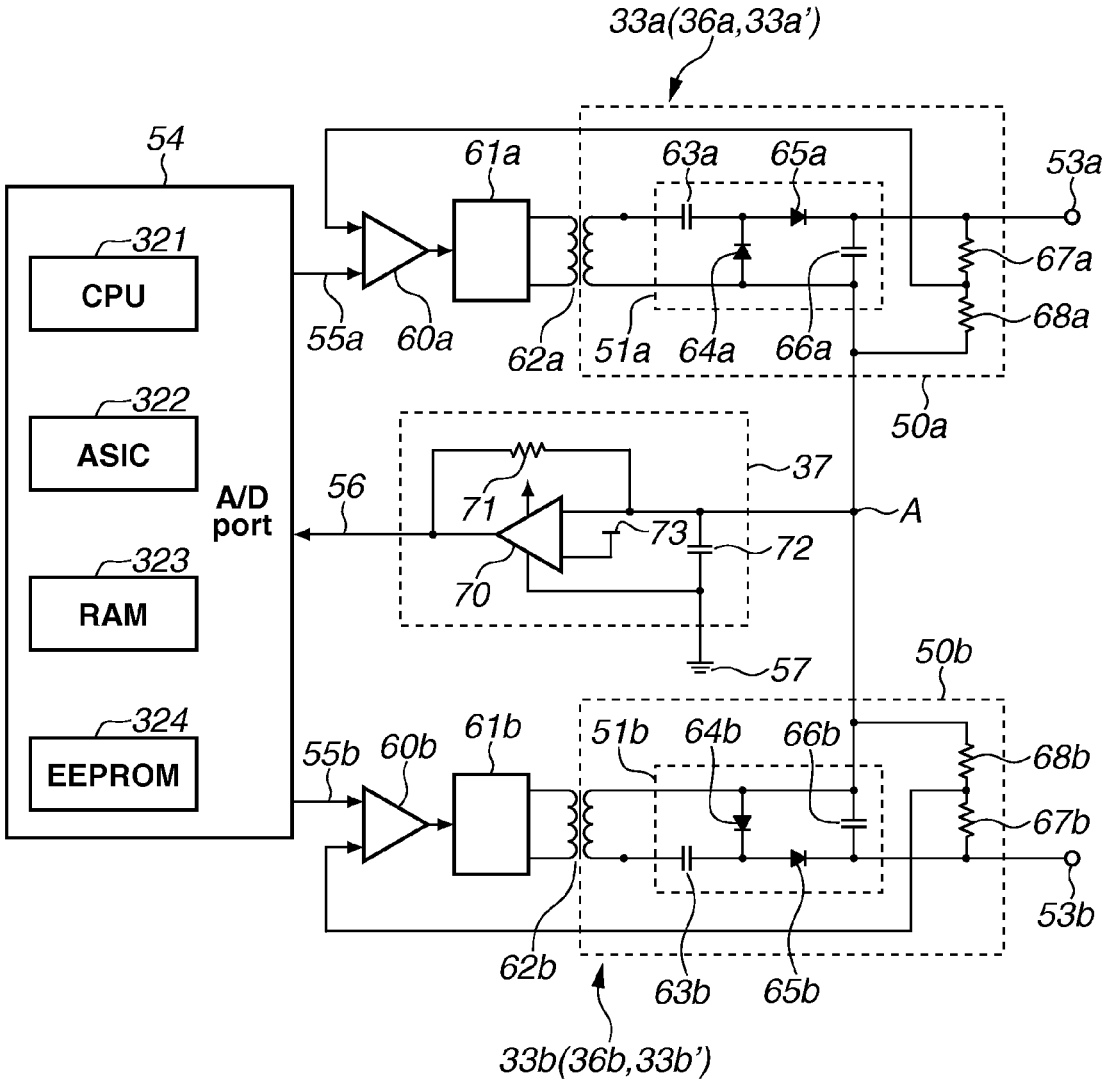
FIG. 5 is a diagram illustrating a configuration of a charging high voltage power source circuit and a current detection circuit according to the first exemplary embodiment.

A control unit 54 in FIG. 5 includes a central processing unit (CPU) 321, an application specific integrated circuit (ASIC) 322, a random access memory (RAM) 323, and an electrically erasable programmable read-only memory (EEPROM) 322 of which the functions will not be described in detail. Transformers 62*a* and 62*b* boost the voltage of an AC signal, generated by each of driving circuits 61*a* and 61*b*, to be increased by several tens of times. Rectifying circuits 51*a* and 52*b*, including diodes 64*a*, 64*b*, 65*a*, and 65*b* and capacitors 63*a*, 63*b*, 66*a*, and 66*b*, rectify/smoothen the boosted voltage AC signal. The rectified/smoothed voltage signal is output to each of output terminals 53*a* and 53*b* as direct current (DC) voltage. Comparators 60*a* and 60*b* controls output voltage of the driving circuits 61*a* and 61*b* in such a manner that voltage of each of the output terminals 53*a* and 53*b* divided by detection resistors 67*a*, 67*b*, 68*a*, and 68*b* becomes equal respectively to values 55*a* and 55*b* set by the control unit 54. Current flows via the charging rollers 3Y, 3M, and 3C, the photosensitive drums 1Y, 1M, and 1C, and the ground, in accordance with the voltage of the output terminal 53*a*. Current flows via the charging roller 3K, the photosensitive drum 1K, and the ground in accordance with the voltage of the output terminal 53*b*.

The current detection circuit 37 is inserted between secondary side circuits 50*a* and 50*b* of the transformers 62*a* and 62*b*, and a ground point 57. Thus, substantially all the DC current flowing from the ground point 57 to the output terminals 53*a* and 53*b* via the secondary side circuits 50*a* and 50*b* of the transformers 62*a* and 62*b*, flows to a resistor 71. An inverting input terminal of an operational amplifier 70 is connected to an output terminal via the resistor 71 and thus is virtually grounded to reference voltage 73 connected to a noninverting input terminal. Thus, detected voltage 56, proportional to the amount of current flowing via the output terminals 53*a* and 53*b*, is obtained at the output terminal of the operational amplifier 70. The inverting input terminal of the operational amplifier 70 is stabilized with a capacitor 72.

<Developing Roller Contact/Separation Control During Printing>

In the image forming apparatus 100 with the configuration described above, the surface potential in an area of the photosensitive drum 1K charged by the charging roller 3K receiving voltage from the high voltage charging power source circuit 33*b*, changes when the high voltage charging power source circuit 33*a* is turned on while the high voltage charging power source circuit 33*b* is in an ON state. An area of the photosensitive drum, in which the surface potential changes, is hereinafter referred to as a surface potential changing portion.

Hence, the present exemplary embodiment has a feature that the developing roller 41K is separated from the photosensitive drum 1K before the surface potential changing portion of the photosensitive drum 1K reaches the contact portion involving the developing roller 41K, when the high voltage charging power source circuit 33*a* is turned on while the high voltage charging power source circuit 33*b* is in the ON state. The operation of the developing roller separating mechanism 60 that causes the developing roller and the photosensitive drum to be in contact with or separated from each other is controlled by the control unit 54.

More specifically, developing roller contact/separation control performed when the image forming apparatus is switched to the full color mode while the printing in the monochrome mode is in process (hereinafter, referred to as "mono-full switching") is described.

Figure 6:
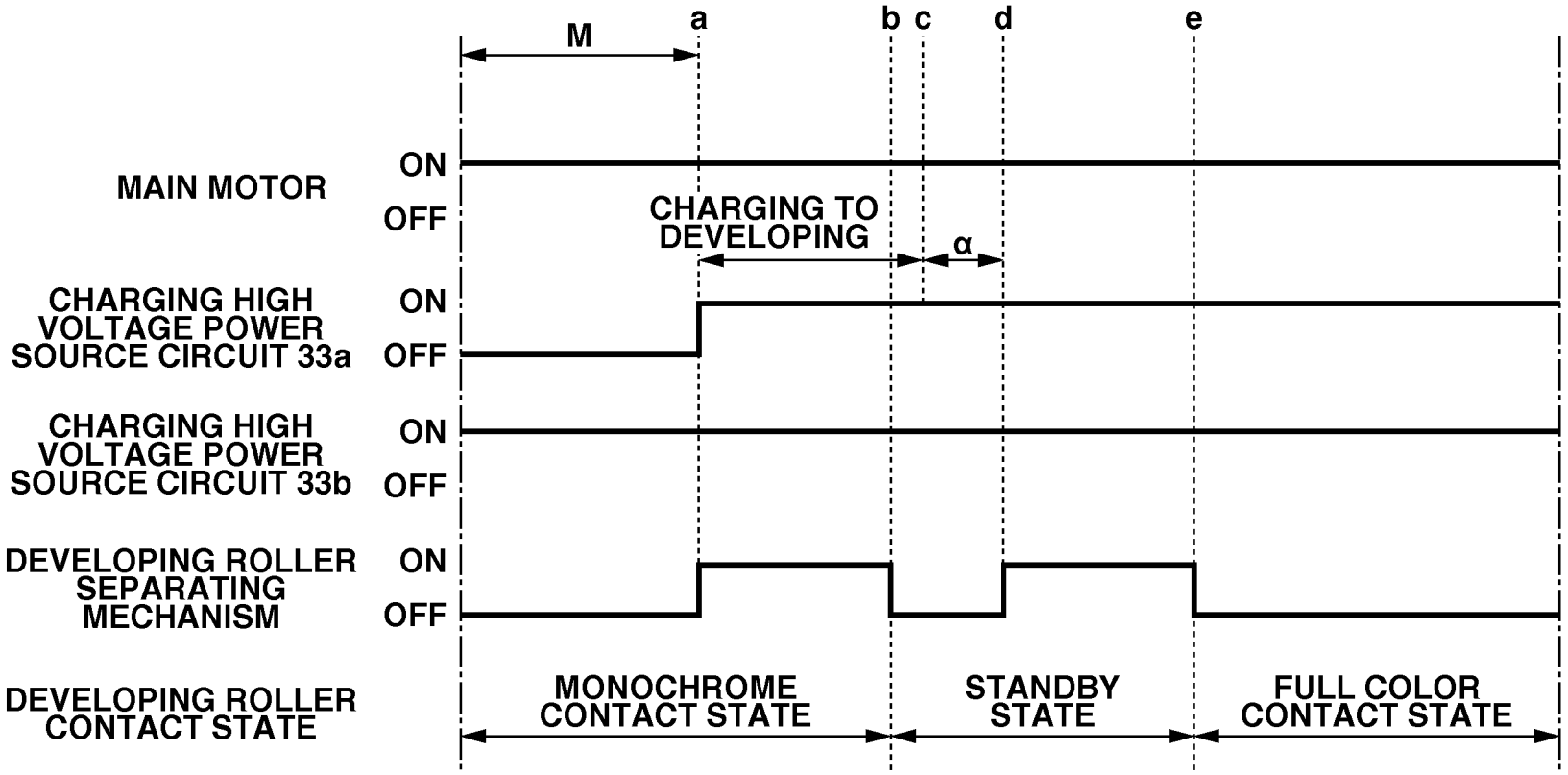
FIG. 6 is a timing chart of mono-color switching according to the first exemplary embodiment.

FIG. 6 is a timing chart illustrating the mono-full switching according to the present exemplary embodiment. In a section M in FIG. 6, printing is performed in the monochrome mode. More specifically, in the section M, the printing is performed in a first mode where no toner image is formed on the photosensitive drums 1Y, 1M, and 1C and the toner image is formed on the photosensitive drum 1K. Thus, during the monochrome printing, the high voltage charging power source circuit 33*a* is in an OFF state, so that undesirable discharging deterioration of the photosensitive drums 1Y, 1M, and 1C is suppressed to achieve a longer service life of the process cartridges PY, PM, and PC. More specifically, while the high voltage charging power source circuit 33*a* is in the OFF state, no voltage or standby voltage for standby is supplied to the output terminal 53*a*. The developing roller contact/separation state of the image forming apparatus 100 at this point is the "monochrome color image forming state" (see FIG. 3C).

When a full color image signal is received from a host computer (not illustrated) while the monochrome printing is in process, the high voltage charging power source circuit 33*a* is turned on to prepare for the full color printing at a post-rotation operation start timing (timing a in FIG. 6) after the monochrome printing is terminated. At this point, an analog signal is transmitted from the control unit 54 so that desired voltage is output from the output terminal 53*a* to the charging rollers 3Y, 3M, and 3C. The post-rotation operation is performed after the primary transferring in the process cartridge P (PK) for the final page is completed in the continuous printing.

In the high voltage power source circuit in the image forming apparatus 100, voltage is suddenly output to the output terminal 53*a* when the high voltage charging power source circuit 33*a* is turned on while the high voltage charging power source circuit 33*b* is in the ON state (at first timing). Thus, charge current instantaneously flows to the current detection circuit 37. This is because when the high voltage charging power source circuit 33*a* is switched from the OFF state where the standby voltage or no voltage is supplied to the output terminal 53*a*, to the ON state, the power source circuit 33*a* performs an operation of supplying the voltage (predetermined voltage) larger than the standby voltage to the output terminal 53*a*. When the charge current flows to the resistor 71, the potential of each of the output terminal and the inverting input terminal of the operational amplifier 70 changes. Thus, a voltage value (voltage value at A in FIG. 5) used as a reference by the high voltage charging power source circuit 33*b* changes, whereby the DC voltage output to the output terminal 53*b*, that is, the DC voltage output to the charging roller 3K changes. The voltage change leads to a change in a surface potential of a portion of the photosensitive drum 1K at the charging position. This surface potential changing portion of the photosensitive drum 1K reaches the portion to be in contact with the developing roller 41K (timing c in FIG. 6) as a result of the driving rotation in the direction indicated by the arrow K in FIG. 2. At this point, the developing roller 41K needs to be separated from the photosensitive drum 1K to prevent the toner from being transferred onto the surface potential changing portion of the photosensitive drum 1K from the developing roller 41K. Thus, the developing roller separating mechanism 60 is operated for a single time so that the image forming apparatus 100 in the "monochrome color image forming state" transitions to the "standby state" (see FIG. 3A). Thus, the apparatus just has to enter the "standby state" before a timing (timing c in FIG. 6, second timing) at which the surface potential changing portion of the photosensitive drum 1K, at the charging position at the first timing, reaches the portion (developing position) to be in contact with the developing roller 41K. In other words, the developing roller 41K just has to at least be at the separation position before the second timing (timing c in FIG. 6) at which the surface potential changing portion of the photosensitive drum 1K reaches the portion to be in contact with the developing roller 41K.

In the present exemplary embodiment, an ON timing of the developing roller separating mechanism 60 is set to be the same as an ON timing of the high voltage charging power source circuit 33*a* (timing a in FIG. 6). Thus, the apparatus enters the "standby state" at a timing (timing b in FIG. 6) before the timing (timing c in FIG. 6) at which the surface potential changing portion of the photosensitive drum 1K reaches the portion to be in contact with the developing roller 41K.

Next, to perform printing in the full color mode, the "full color image forming state" needs to be achieved by further operating the developing roller separating mechanism 60 for a single time. The developing roller separating mechanism 60 may be turned on after the surface potential changing portion of the photosensitive drum 1K passes through the portion to be in contact with the developing roller 41K so that the toner is prevented from being transferred onto the photosensitive drum 1K from the developing roller 41K. Thus, the second operation of the developing roller separating mechanism 60 starts (timing d in FIG. 6) after a time period a, during which the surface potential changing portion passes through the portion to be in contact with the developing roller 41K, elapses. Then, the full color image forming starts at a timing (timing e in FIG. 6) at which the apparatus enters the "full color image forming state" with the developing rollers 41Y, 41M, 41C, and 41K of all of the process cartridges PY, PM, PC, and PK respectively in contact with the photosensitive drums 1Y, 1M, 1C, and 1K. The full color image forming state corresponds to a second mode in which the toner image is formed on each of the photosensitive drums 1Y, 1M, 1C, and 1K.

With the control described above, the toner is not transferred onto the surface potential changing portion of the photosensitive drum 1K as a result of turning on the high voltage charging power source circuit 33*a* while the high voltage charging power source circuit 33*b* is in the ON state. Thus, a favorable image with no image failure can be obtained.

The high voltage charging power source circuit 33*a* in the ON state supplies voltage (predetermined voltage), larger than the standby voltage, to the output terminal 53*a*. The predetermined voltage is image forming charging voltage with which the photosensitive drums 1Y, 1M, and 1C are charged to reach a potential desired for the full color image forming. Alternatively, the predetermined voltage is adjusting voltage which is close to the charging voltage for image forming for performing adjustment so that charging voltage suitable for image forming can be supplied.

<Operation and Effect of Present Exemplary Embodiment>

As described above, in the image forming apparatus, the high voltage charging power source circuit 33*b* as the first power source and the high voltage charging power source circuit 33*a* as the second power source that are independent from each other are grounded via the common current detection circuit 37. Here, when the high voltage charging power source circuit 33*a* as the second power source is turned on while the high voltage charging power source circuit 33*b* as the first power source is in the ON state, a value of the voltage output from the high voltage charging power source circuit 33*b* as the first power source is changed as a result of turning on the high voltage charging power source circuit 33*a* as the second power source. In the present exemplary embodiment, the developing roller 41K on a side to which the voltage is supplied from the high voltage charging power source circuit 33*b* as the first power source, is separated from the photosensitive drum 1K before the surface potential changing portion of the photosensitive drum 1K affected by the change, reaches the portion to be in contact with the developing roller 41K. Thus, no developer is transferred onto the surface potential changing portion of the photosensitive drum affected by the change, whereby an excellent image with no image failure such as a traverse line can be obtained.

[Modification 1]

A modification of the first exemplary embodiment described above is described. In the image forming apparatus 100 to which the present modification is applied, components that are the same as those in the first exemplary embodiment are denoted with the same reference numerals and will not be described in detail.

<Feature of the Present Modification>

In the image forming apparatus 100 according to the present modification, a primary transfer high voltage power source circuit 36*b* and a primary transfer high voltage power source circuit 36*a*, independent from each other, are connected to each other via the common current detection circuit 37. The primary transfer high voltage power source circuit 36*b* is a first power source that supplies voltage to the transfer roller 17K. The primary transfer high voltage power source circuit 36*a* is a second power source that supplies voltage to the transfer rollers 17Y, 17M, and 17C and not to the transfer roller 17K.

Figure 7:
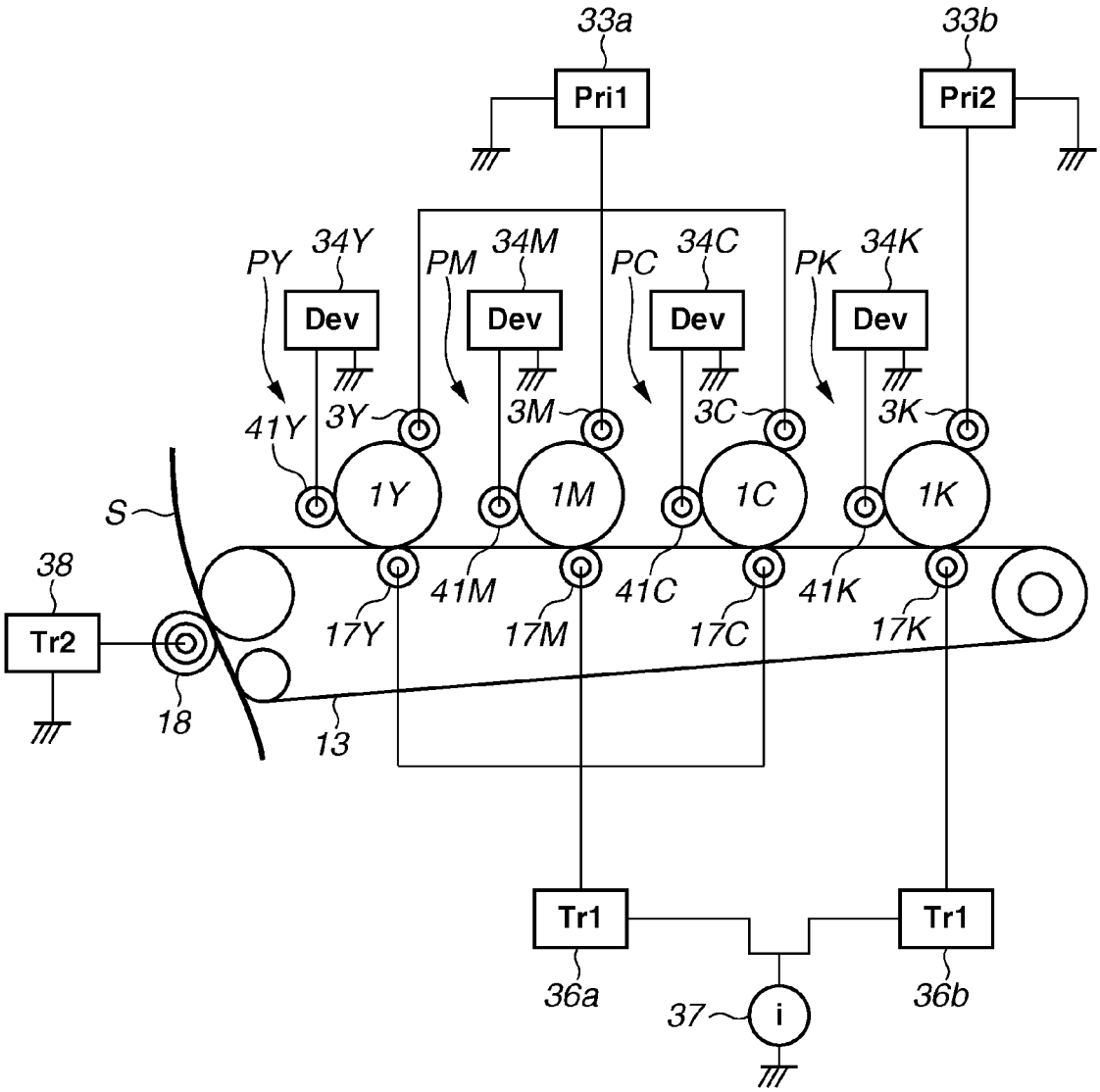
FIG. 7 is a diagram illustrating a configuration of a high voltage power source device according to a modification of the first exemplary embodiment.

FIG. 7 is a diagram illustrating a configuration of a high voltage power source device according to the present modification. As illustrated in FIG. 7, the primary transfer high voltage power source circuit 36*a* is connected to and supplies voltage to the transfer rollers 17Y, 17M, and 17C. The primary transfer high voltage power source circuit 36*b* is connected to and supplies voltage to the transfer roller 17K. The primary transfer high voltage power source circuit 36*a* and the primary transfer high voltage power source circuit 36*b* are connected to each other via the common current detection circuit 37.

The high voltage power source circuit is the same as that described in the first exemplary embodiment with reference to FIG. 5. The voltage is supplied from the output terminal 53*a* to the transfer rollers 17Y, 17M, and 17C, and is supplied from the output terminal 53*b* to the transfer roller 17K.

<Developing Roller Contact/Separation Control During Printing>

Specific control performed in the mono-full switching according to the present modification is described below.

Figure 8:
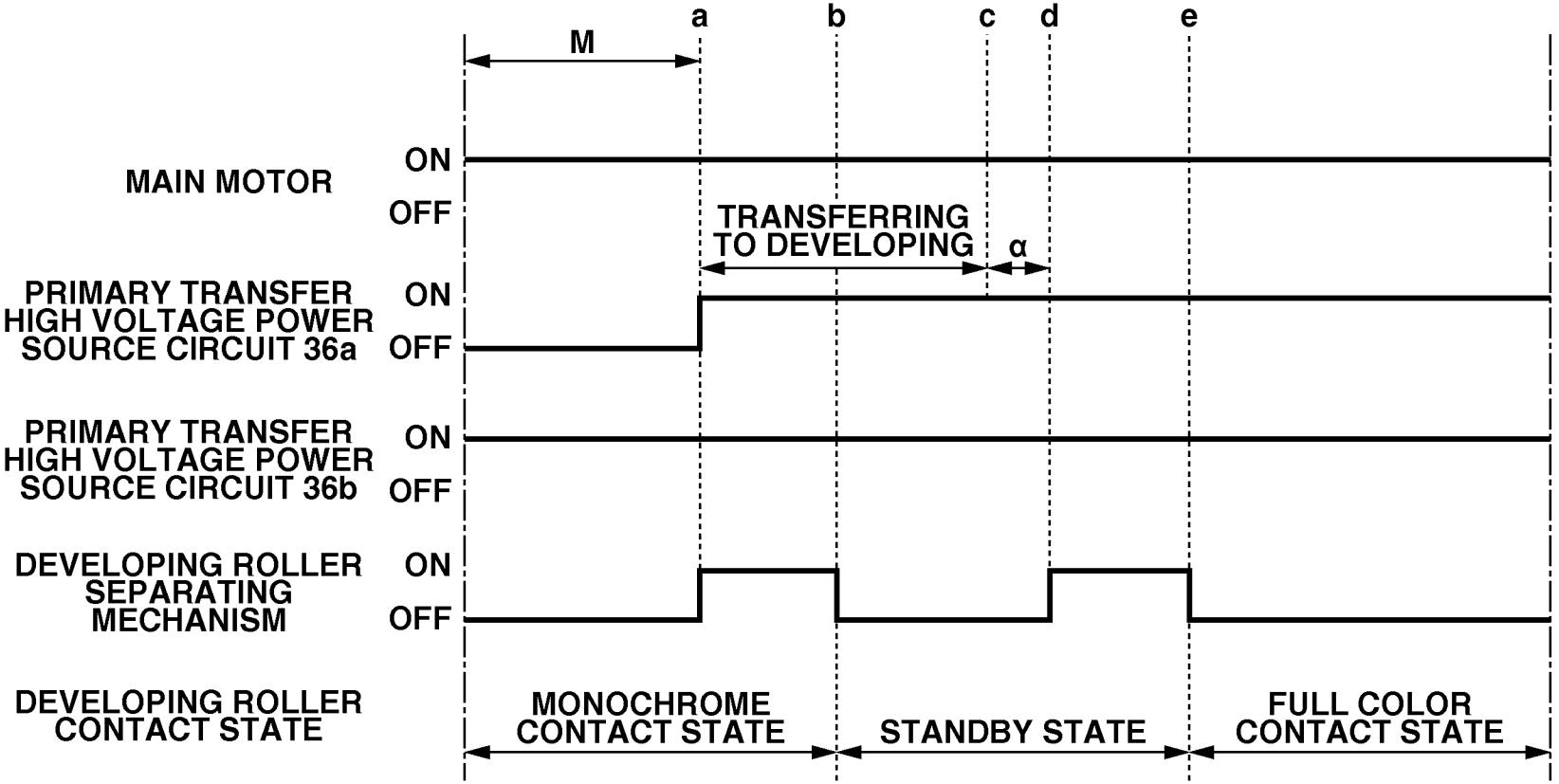
FIG. 8 is a timing chart of mono-color switching according the modification of the first exemplary embodiment.

FIG. 8 is a timing chart illustrating the mono-full switching according to the present modification. As in the first exemplary embodiment (FIG. 6), the monochrome printing is performed in the section M, and the post-rotation operation starts at the timing a.

During the monochrome printing, the primary transfer high voltage power source circuit 36*a* in the OFF state supplies no voltage or standby voltage to the output terminal 53*a*. When a full color image signal is received while the monochrome printing is in process, the primary transfer high voltage power source circuit 36*a* is turned on to prepare for the full color printing at the first timing (timing a in FIG. 8). Also in the high voltage power source circuit according to the present modification, when the primary transfer high voltage power source circuit 36*a* is turned on while the primary transfer high voltage power source circuit 36*b* is in the ON state, the charge current instantaneously flows to the current detection circuit 37. This is because when the primary transfer high voltage power source circuit 36*a* is switched from the OFF state, where the standby voltage or no voltage is supplied to the output terminal 53*a*, to the ON state, the primary transfer high voltage power source circuit 36*a* operates to supply the voltage (predetermined voltage) larger than the standby voltage, to the output terminal 53*a*. Thus, a voltage value (voltage value at A in FIG. 5) used as a reference by the primary transfer high voltage power source circuit 36*b* changes, whereby the DC voltage output to the output terminal 53*b*, that is, the DC voltage output to the transfer roller 17K changes. The voltage change causes overcurrent to instantaneously flow from the transfer roller 17K to the photosensitive drum 1K, and thus transfer memory occurs. The transfer memory cannot be eliminated with a single charging operation, and thus leads to uneven surface potential on the photosensitive drum 1K. Thus, also in the present modification, the developing roller 41K needs to be separated from the photosensitive drum 1K so that no toner is transferred onto the photosensitive drum 1K from the developing roller 41K. Accordingly, the apparatus should enter the "standby state" before a timing (timing c in FIG. 8) at which an area (surface potential changing portion) of the photosensitive drum 1K, which is affected by transfer roller with the changed voltage and is at the transferring position at the first timing, reaches the portion to be in contact with the developing roller 41K (developing position).

In the present modification, the ON timing of the developing roller separating mechanism 60 is set to be the same as a first ON timing of the primary transfer high voltage power source circuit 36*a* (timing a in FIG. 8). Thus, the apparatus enters the "standby state" at a timing before the timing (timing c in FIG. 8) at which the surface potential changing portion of the photosensitive drum 1K reaches the portion to be in contact with the developing roller 41K.

Also in the present modification, the "full color image forming state" may be achieved with the developing roller separating mechanism 60 turned on after the surface potential changing portion of the photosensitive drum 1K passes through the portion to be in contact with the developing roller 41K. Thus, the second operation of the developing roller separating mechanism 60 is started (timing d in FIG. 8) after the time period a, during which the surface potential changing portion passes through the portion to be in contact with the developing roller 41K, elapses. Then, the full color image forming starts at a timing (timing e in FIG. 8) at which the apparatus enters the "full color image forming state".

With the control described above, no toner is transferred onto the surface potential changing portion of the photosensitive drum 1K as a result of turning on the primary transfer high voltage power source circuit 36*a*. Thus, a favorable image with no image failure can be obtained.

The primary transfer high voltage power source circuit 36*a* in the ON state supplies voltage (predetermined voltage) larger than the standby voltage, to the output terminal 53*a*. The predetermined voltage is image forming charging voltage with which the photosensitive drums 1Y, 1M, and 1C are charged to reach a potential suitable for forming a full color image. Alternatively, the predetermined voltage is adjusting voltage close to the image forming charging voltage, for performing adjustment so that charging voltage suitable for image forming can be supplied.

<Operation and Effect of Present Modification>

As described above, in the image forming apparatus, the first primary transfer high voltage power source circuit 36*b* and the second primary transfer high voltage power source circuit 36*a* that are independent from each other are grounded via the common current detection circuit 37. Here, when the second primary transfer high voltage power source circuit 36*a* is turned on while the first primary transfer high voltage power source circuit 36*b* is in the ON state, a value of the voltage output from the first primary transfer high voltage power source circuit 36*b* is changed as a result of turning on the second primary transfer high voltage power source circuit 36*a*. In the present modification, the developing roller on a side to which the voltage is supplied from the first primary transfer high voltage power source circuit 36*b*, is separated from the photosensitive drum before the surface potential changing portion of the photosensitive drum affected by the change reaches the portion to be in contact with the developing roller. Thus, no developer is transferred onto the surface potential changing portion of the photosensitive drum affected by the change, whereby a favorable image with no image failure such as a traverse line can be obtained.

Next, a second exemplary embodiment will be described. In the image forming apparatus 100 to which the present exemplary embodiment is applied, components that are the same as those in the first exemplary embodiment are denoted with the same reference numerals and will not be described.

<Feature of the Present Exemplary Embodiment>

In the image forming apparatus 100 according to the present exemplary embodiment, the charging rollers 3Y, 3M, and 3C and the developing rollers 41Y, 41M, and 41C receive voltage from the same high voltage power source. The charging roller 3K and the developing roller 41K receive voltage from the same high voltage power source. Thus, the power source that supplies voltage to the charging roller further applies voltage to the developing roller. In other words, a feature of the present exemplary embodiment is that the voltage is applied to the charging roller and the developing roller from the same power source.

Figure 9:
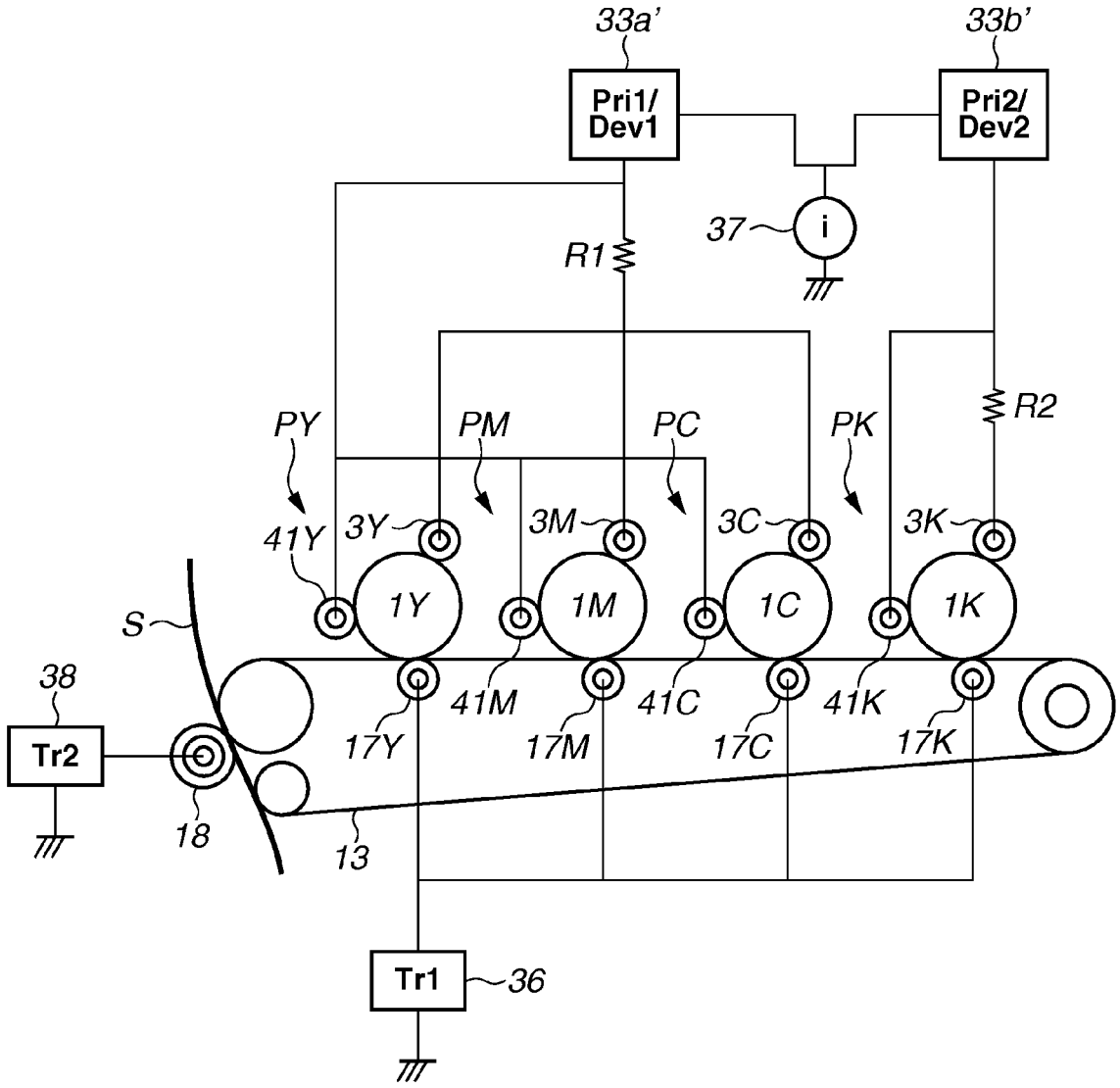
FIG. 9 is a diagram illustrating a configuration of a high voltage power source device according to a second exemplary embodiment.

FIG. 9 is a diagram illustrating a configuration of a high voltage power source device according to the present exemplary embodiment. As illustrated in FIG. 9, a charging and developing high voltage power source circuit 33*a*', as a second power source, is connected to and supplies voltage (developing voltage) to the developing rollers 41Y, 41M, and 41C, and is connected to the charging rollers 3Y, 3M, and 3C via a common resistor R1. A charging and developing high voltage power source circuit 33*b*', as a first power source, is connected to and supplies voltage to the developing roller 41K and is connected to the charging roller 3K via a resistor R2. Thus, cost reduction is achieved by using a single high voltage power source as the high voltage charging power source and the developing high voltage power source.

The high voltage power source circuit is the same as that described in the first exemplary embodiment with reference to FIG. 5. The voltage is supplied from the output terminal 53*a* to the charging rollers 3Y, 3M, and 3C and the developing rollers 41Y, 41M, and 41C, and the voltage is supplied from the output terminal 53*b* to the charging roller 3K and the developing roller 41K, respectively.

<Developing Roller Contact/Separation Control During Printing>

Specific control performed in the mono-full switching according to the present exemplary embodiment is described below.

Figure 10:
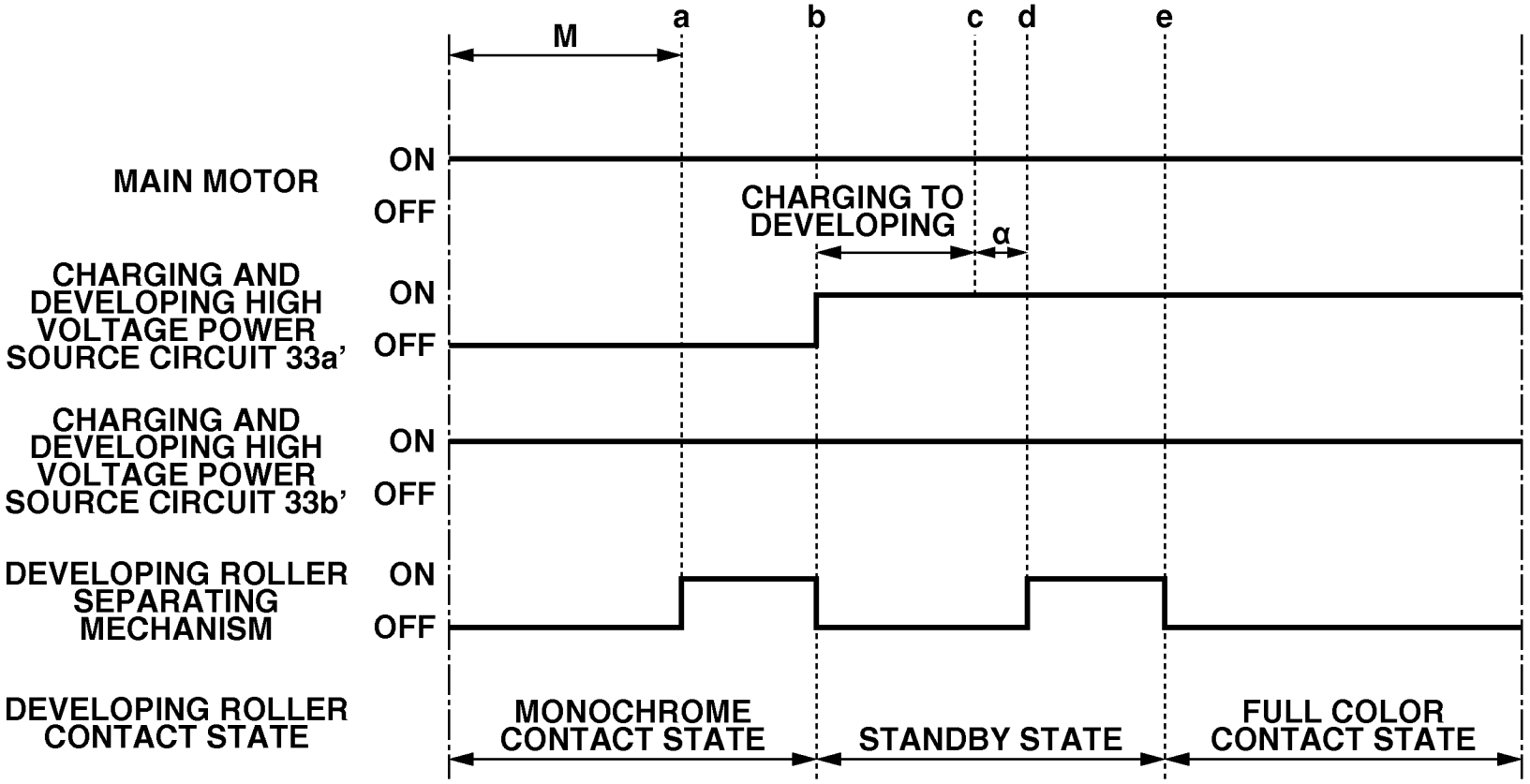
FIG. 10 is a timing chart of mono-full switching according to the second exemplary embodiment.

FIG. 10 is a timing chart illustrating the mono-full switching according to the present exemplary embodiment. As in the first exemplary embodiment, the printing is performed in monochrome mode in the section M, and the post-rotation operation starts at the timing a.

When a full color image signal is received while the monochrome color printing is in process, the charging and developing high voltage power source circuit 33*a*' is turned on to prepare for the full color printing. Also in the high voltage power source circuit according to the present exemplary embodiment, when the charging and developing high voltage power source circuit 33*a*' is turned on while the charging and developing high voltage power source circuit 33*b*' is in the ON state, the charge current instantaneously flows to the current detection circuit 37. Thus, a voltage value (voltage value at A in FIG. 5) used as a reference by the charging and developing high voltage power source circuit 33*b*' changes. Here, in the present exemplary embodiment, the DC voltage output to the charging roller 3K and the developing roller 41K changes. Thus, not only the surface potential on the photosensitive drum 1K is changed by the voltage change of the charging roller 3K, but also the photosensitive drum 1K is directly affected by the voltage change of the developing roller 41K. Thus, the toner may be transferred onto the photosensitive drum 1K from the developing roller 41K. Thus, in the high voltage power source circuit, the "standby state" needs to be achieved when the charging and developing high voltage power source circuit 33*a*' is turned on.

Thus, in the present exemplary embodiment, only the operation of the developing roller separating mechanism starts at the post-rotation operation start timing (timing a in FIG. 10). Then, the charging and developing high voltage power source circuit 33*a*' is turned on at a timing (timing b in FIG. 10) at which the apparatus enters the "standby state". Then, the surface potential changing portion affected by the charging portion of the photosensitive drum 1K reaches the portion to be in contact with the developing roller 41*k* (timing c in FIG. 10). Then, the second operation of the developing roller separating mechanism 60 starts (timing d in FIG. 10) after the time period a has elapsed, during which the surface potential changing portion passes through the portion to be in contact with the developing roller 41K. Then, the full color image forming starts at a timing (timing e in FIG. 10) at which the apparatus enters the "full color image forming state".

With the control described above, no toner is transferred onto the surface potential changing portion of the photosensitive drum 1K as a result of turning on the charging and developing high voltage power source circuit 33*a*', or onto the portion to be in contact with the developing roller 41K. Thus, a favorable image with no image failure can be obtained.

<Operation and Effect of Present Exemplary Embodiment>

As described above, in the image forming apparatus, the first charging and developing high voltage power source circuit 33*b*' and the second charging and developing high voltage power source circuit 33*a*', which are the common charging and developing high voltage power sources independent from each other, are grounded via the common current detection circuit 37. Here, when the second charging and developing high voltage power source circuit 33*a*' is turned on while the first charging and developing high voltage power source circuit 33*b*' is in the ON state, a value of the voltage output from the first charging and developing high voltage power source circuit 33*b*' changes as a result of turning on the second charging and developing high voltage power source circuit 33*a*'. In the present exemplary embodiment, the developing roller on a side to which the voltage is supplied from the first charging and developing high voltage power source circuit 33*b*' is separated from the photosensitive drum before the second charging and developing high voltage power source circuit 33*a*' is turned on. Thus, a cost reduction of high voltage power source circuit can be achieved with which an excellent image with no image failure such as a traverse line can be obtained.

Next, a third exemplary embodiment will be described. In the image forming apparatus 100 according to the present exemplary embodiment, components that are the same as those in the first exemplary embodiment are denoted with the same reference numerals and will not be described.

<Feature of the Present Exemplary Embodiment>

The image forming apparatus 100 according to the present exemplary embodiment has a feature that the high voltage charging power source circuit 33*a* and the high voltage charging power source circuit 33*b* are grounded to a frame ground of a main body via a common resistor component.

Figure 11:
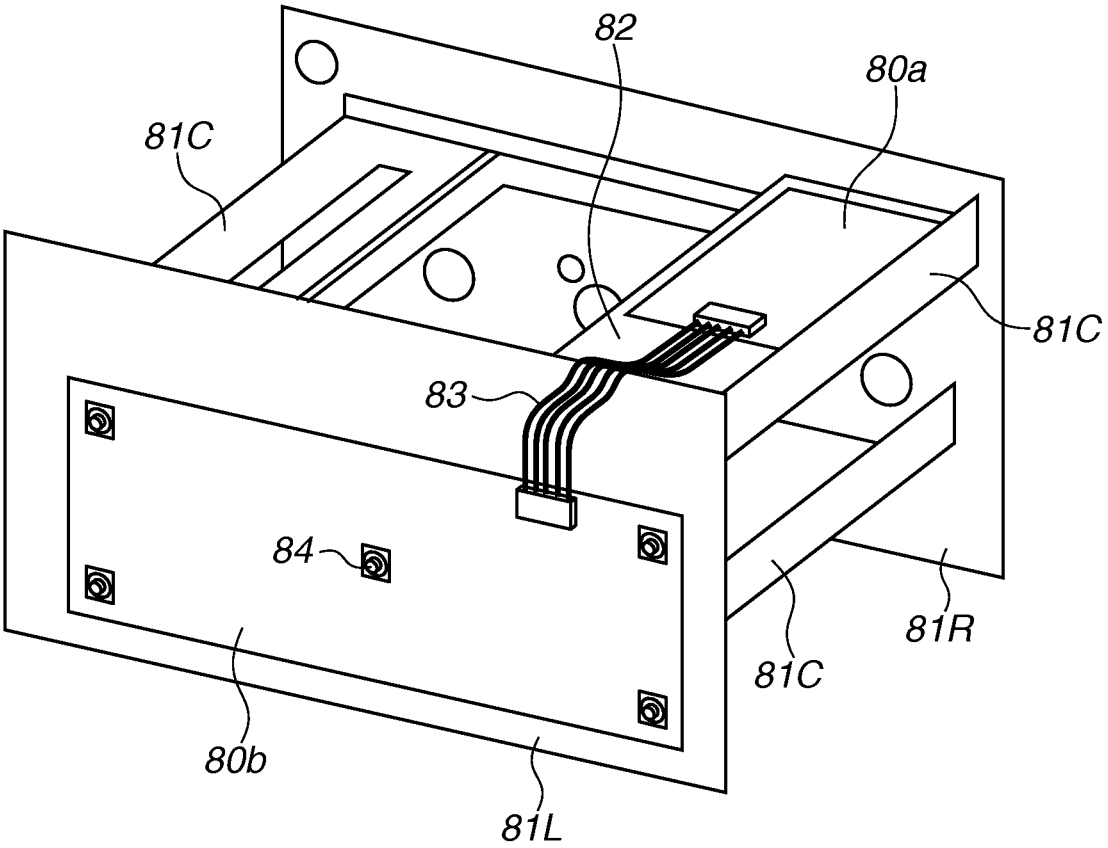
FIG. 11 is a schematic view of main body sheet metal frames according to a third exemplary embodiment.

FIG. 11 is a schematic view of a main body sheet metal frame of the image forming apparatus 100. In FIG. 11, left and right main body sheet metal frames 81L and 81R are fixed by center sheet metal frames 81C. A high voltage substrate 80*a*, on which the high voltage power source circuit including the high voltage charging power source circuit 33*a* and the high voltage charging power source circuit 33*b*, is pasted, is placed on a mold member 82 supported by the center sheet metal frame 81C. A high voltage substrate 80*b*, on which the high voltage power source circuit including the primary transfer high voltage power source, the secondary transfer high voltage power source, and the like, is pasted, is fixed to the main body sheet metal frame 81L with a plurality of metal screws 84. Thus, the high voltage substrate 80*b* is grounded to the main body frame ground. The high voltage substrate 80*a* is connected to the high voltage substrate 80*b* via cable lines 83, and thus is grounded to the main body frame ground via resistor components such as the cable lines 83 and the high voltage substrate 80*b*.

Figure 12:
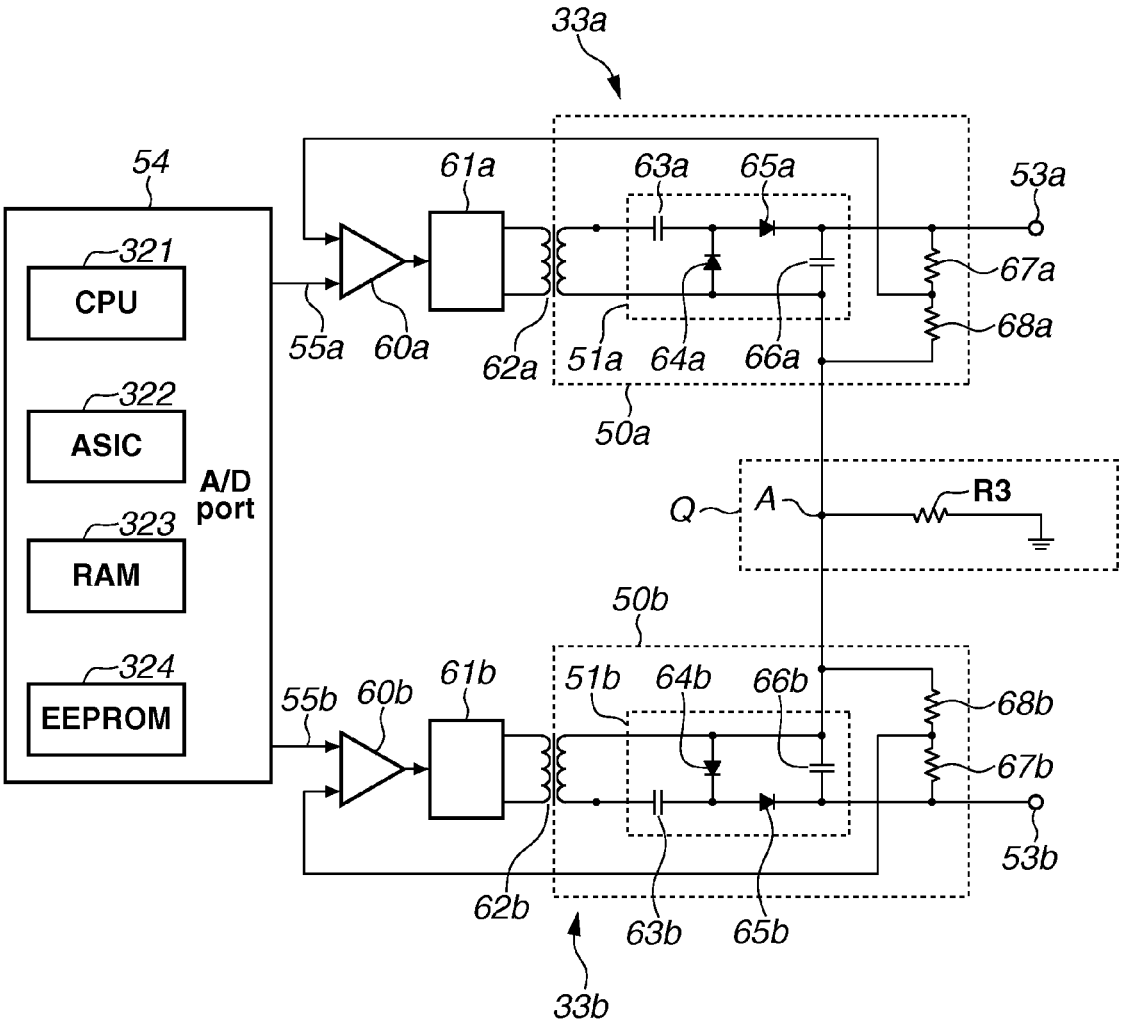
FIG. 12 is a diagram illustrating a configuration of a high voltage charging power source circuit according to the third exemplary embodiment.

In the present exemplary embodiment, the current detection circuit 37 (see FIG. 5) described as the resistor component in the first exemplary embodiment is not provided. Thus, the high voltage charging power source circuit 33*a* and the high voltage charging power source circuit 33*b* are not connected to each other on the high voltage power source circuit. Still a circuit configuration illustrated in FIG. 12 is achieved with the high voltage substrate 80*b* described above. A portion Q illustrated in FIG. 12 that is not an actual circuit represents a resistor component R3 including the cable lines 83 and the high voltage substrate 80*b*. More specifically, in the present exemplary embodiment, the high voltage charging power source circuit 33*a* and the high voltage charging power source circuit 33*b* are grounded via the resistor component R3 including the cable lines 83 and the high voltage substrate 80*b*.

<Developing Roller Contact/Separation Control During Printing>

Specific control performed in the mono-full switching according to the present exemplary embodiment is described below. The timing of each operation is the same as that in FIG. 6 and thus will not be described in detail.

When a full color image signal is received while the monochrome printing is in process, the high voltage charging power source circuit 33*a* is turned on to prepare for the full color printing at the post-rotation operation start timing (timing a in FIG. 6) after the monochrome color printing is terminated. As in the first exemplary embodiment, when the high voltage charging power source circuit 33*a* is turned on while the high voltage charging power source circuit 33*b* is in the ON state, the voltage is suddenly output to the output terminal 53*a*, whereby the charge current instantaneously flows to the portion Q in FIG. 12. When the charge current flows to the resistor R3, a voltage value at the portion A in FIG. 12 changes, whereby the DC voltage output to the output terminal 53*b* changes. Thus, the operation of the developing roller separating mechanism 60 starts at the timing (timing b in FIG. 6) so that the separation is surely performed when the surface potential changing portion of the photosensitive drum 1K changed by the voltage change reaches the portion to be in contact with the developing roller 41K (timing c in FIG. 6). Then, the surface potential changing portion of the photosensitive drum 1K affected by the charging portion reaches the portion to be in contact with the developing roller 41*k* (timing c in FIG. 6). Then, the second operation of the developing roller separating mechanism 60 starts (timing d in FIG. 6) after the time period a has elapsed, during which the surface potential changing portion passes through the portion to be in contact with the developing roller 41K. Then, the full color image forming starts at the timing (timing e in FIG. 6) at which the apparatus enters the "full color image forming state" with all of the developing rollers in contact with the photosensitive drums.

With the control described above, no toner is transferred onto the surface potential changing portion of the photosensitive drum 1K as a result of turning on the high voltage charging power source circuit 33*a*. Thus, a favorable image with no image failure can be obtained.

<Operation and Effect of Present Exemplary Embodiment>

As described above, in the image forming apparatus, the high voltage charging power source circuit 33*b* and the high voltage charging power source circuit 33*a* that are independent from each other are grounded to the main body frame ground via the common resistor component R3. Here, when the high voltage charging power source circuit 33*a* as the second power source is turned on while the high voltage charging power source circuit 33*b* as the first power source is in the ON state, a value of the voltage output from the high voltage charging power source circuit 33*b* as the first power source is changed as a result of turning on the high voltage charging power source circuit 33*a* as the second power source. In the present exemplary embodiment, the developing roller on a side to which the voltage is supplied from the high voltage charging power source circuit 33*b* as the first power source is separated from the photosensitive drum before the surface potential changing portion of the photosensitive drum affected by the change reaches the portion to be in contact with the developing roller. Thus, as in the first exemplary embodiment, no developer is transferred onto the surface potential changing portion of the photosensitive drum affected by the change, whereby an excellent image with no image failure such as a traverse line can be obtained.

By using the common charging and developing high voltage power sources, a cost reduction of the high voltage power source circuit can be achieved as in the second exemplary embodiment.

Further, for example, the present exemplary embodiment can be also applied to a case where the high impedance high voltage substrate, on which the high voltage charging power source circuit and the high voltage charging power source circuit are pasted, is directly grounded to the frame ground, that is, when a resistor component is disposed between the high impedance high voltage substrate and the frame ground.

[Other Embodiments]

In the exemplary embodiments described above, the first and the second power sources are respectively the first and the second high voltage charging power source circuits independent from each other, or are respectively the first and the second primary transfer high voltage power source circuits independent from each other. Thus, the method of controlling the first and the second power sources as the high voltage power source circuits of the same type has been described. However, the present invention is not limited to this. For example, the first power source as the high voltage charging power source circuit that supplies the charging voltage to the first charging unit that processes the first photosensitive drum, and the second power source as the primary transfer high voltage power source circuit or the secondary transfer high voltage power source circuit, may be grounded to the frame ground of the main body via a common resistor component. Furthermore, the first power source as the primary transfer high voltage power source circuit that supplies the transfer voltage to the first transfer unit that processes the first photosensitive drum, and the second power source as the high voltage charging power source circuit or the secondary transfer high voltage power source circuit, may be grounded to the frame ground of the main body via the common resistor component. As described above, the present invention can be similarly applied to a configuration in which the first power source as the first high voltage power source circuit that supplies voltage to the process unit that processes the first photosensitive drum (photosensitive drum 1K), and the second power source as a high voltage power source circuit different from the first high voltage power source circuit, are grounded via the common resistor component.

When the high voltage charging power source circuit is the first power source, the first developing member may be controlled by a separating mechanism in the following manner. More specifically, when the second power source in the state of supplying no voltage or supplying voltage lower than the predetermined voltage at the first timing, starts to supply the predetermined voltage while the first power source is supplying the charging voltage, the first developing member is moved to the separation position before the second timing at which the area of the first photosensitive drum that is at the charging position at the first timing reaches the developing position.

When the first power source is the primary transfer high voltage power source circuit, the first developing member is controlled as follows with a separating mechanism. More specifically, when the second power source, in the state of supplying no voltage or supplying voltage lower than the predetermined voltage at the first timing, starts to supply the predetermined voltage while the first power source is supplying the transfer voltage, the first developing member is moved to a separation position before the second timing at which the area of the first photosensitive drum that is at the transferring position at the first timing reaches the developing position.

By controlling the separating mechanism as described above, the image failure caused by a distorted toner image formed on the first photosensitive drum can be suppressed.

In the exemplary configuration described above in the first exemplary embodiment, the timing at which the developing roller and the photosensitive drum are separated from each other is set to be the same as the timing at which the second power source is turned on when the second power source is turned on while the first power source is in the ON state. However, the present invention is not limited to this, and the separation timing may be any timing before the surface potential changing portion of the photosensitive drum affected by the voltage change reaches the portion to be in contact with the developing roller.

The process cartridge exemplified in the exemplary embodiments described above is detachably attached to the image forming apparatus main body, and includes the photosensitive drum and the charging unit, the developing member, and the cleaning unit as process units that process the photosensitive drum and are integrally formed. However, the present invention is not limited to this. For example, a process cartridge may include the photosensitive drum and any one of the charging unit, the developing member, and the cleaning unit that is integrally formed with the photosensitive drum.

The present invention is not limited to the configuration described in the above exemplary embodiments in which the process cartridge including the photosensitive drum is detachably attached to the image forming apparatus main body. For example, the present invention may be applied to an image forming apparatus incorporating each component, or an image forming apparatus to which the components are detachably attached.

The present invention is not limited to the printer exemplified as the image forming apparatus in the exemplary embodiments described above, and may be applied to other image forming apparatuses such as a copying machine, a facsimile device, and a multifunction peripheral having the functions of these apparatuses. The present invention is not limited to the image forming apparatus in which the toner images of each color are sequentially transferred onto the intermediate transferring member while overlapping each other and then are collectively transferred onto a recording medium. The present invention may be also applied to an image forming apparatus in which the toner images of each color are sequentially transferred onto a recording medium as a transfer target on a recording medium bearing member. The effects that are the same as those described above can be similarly obtained by applying the present invention to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-215173, filed Oct. 22, 2014, and No. 2015-197806, filed Oct. 5, 2015, which are hereby incorporated by reference herein in their entirety.

What is claimed is:

1. An image forming apparatus comprising:

first and second photosensitive members configured to be rotatably driven;

first and second charging units configured to respectively charge the first and the second photosensitive members at respective charging positions;

first and second developing members configured to cause toner to attach to the first and the second photosensitive members at respective developing positions;

first and second transfer units configured to transfer toner images formed on the first and the second photosensitive members onto a transfer target;

a first power source configured to supply charging voltage to the first charging unit;

a second power source configured to supply predetermined voltage to at least one of the second charging unit, the second developing member, and the second transfer unit;

a separating mechanism configured to move the first developing member from a contact position where the first developing member is in contact with the first photosensitive member at the developing position to a separation position where the first developing member is separated from the first photosensitive member; and a control unit configured to control the separating mechanism;

wherein the first and the second power sources are grounded via a common resistor component, and wherein when the second power source in a state of supplying no voltage or supplying voltage lower than the predetermined voltage at a first timing starts supplying the predetermined voltage while the first power source is supplying the charging voltage, the control unit causes the separating mechanism to move the first developing member to the separation position before a second timing at which an area of the first photosensitive member that is at the charging position at the first timing reaches the developing position.

2. The image forming apparatus according to claim 1, wherein the predetermined voltage is supplied to the second charging unit.

3. The image forming apparatus according to claim 1, wherein the predetermined voltage is supplied to the second developing member.

4. The image forming apparatus according to claim 1, wherein the predetermined voltage is supplied to the second transfer unit.

5. The image forming apparatus according to claim 1, wherein the first power source supplies developing voltage to the first developing member, and wherein the control unit causes the separating mechanism to move the first developing member to the separation position before the first timing.

6. The image forming apparatus according to claim 1, wherein the image forming apparatus is capable of performing printing in a first mode of forming the toner image on the first photosensitive member without forming the toner image on the second photosensitive member and printing in a second mode of forming the toner images on the first and the second photosensitive members, and wherein the first timing is a timing before the printing in the second mode is started after the printing in the first mode is terminated.

7. The image forming apparatus according to claim 6, wherein before the printing in the second mode is started after the second timing, the separating mechanism moves the first developing member from the separation position to the contact position.

8. The image forming apparatus according to claim 1, wherein the common resistor component is a current detection circuit, and wherein the control unit controls voltage supplied by the first power source and voltage supplied by the second power source based on current detected by the current detection circuit.

9. An image forming apparatus comprising:

first and second photosensitive members configured to be rotatably driven;

first and second charging units configured to respectively charge the first and the second photosensitive members;

first and second developing members configured to cause toner to attach to the first and the second photosensitive members at respective developing positions;

first and second transfer units configured to transfer toner images formed on the first and the second photosensitive members onto a transfer target at respective transfer positions;

a first power source configured to supply transfer voltage to the first transfer unit;

a second power source configured to supply predetermined voltage to at least one of the second charging unit, the second developing member, and the second transfer unit;

a separating mechanism configured to move the first developing member from a contact position where the first developing member is in contact with the first photosensitive member at the developing position to a separation position where the first developing member is separated from the first photosensitive member; and a control unit configured to control the separating mechanism;

wherein the first and the second power sources are grounded via a common resistor component, and wherein when the second power source in a state of supplying no voltage or supplying voltage lower than the predetermined voltage at a first timing starts supplying the predetermined voltage while the first power source is supplying the transfer voltage, the control unit causes the separating mechanism to move the first developing member to the separation position before a second timing at which an area of the first photosensitive member that is at the transfer position at the first timing reaches the developing position.

10. The image forming apparatus according to claim 9, wherein the predetermined voltage is supplied to the second charging unit.

11. The image forming apparatus according to claim 9, wherein the predetermined voltage is supplied to the second developing member.

12. The image forming apparatus according to claim 9, wherein the predetermined voltage is supplied to the second transfer unit.

13. The image forming apparatus according to claim 9, wherein the control unit causes the separating mechanism to move the first developing member to the separation position before the first timing.

14. The image forming apparatus according to claim 9, wherein the image forming apparatus is capable of performing printing in a first mode of forming the toner image on the first photosensitive member without forming the toner image on the second photosensitive member and performing printing in a second mode of forming the toner images on the first and the second photosensitive members, and wherein the first timing is a timing before the printing in the second mode is started after the printing in the first mode is terminated.

15. The image forming apparatus according to claim 14, wherein before the printing in the second mode is started after the second timing, the separating mechanism moves the first developing member from the separation position to the contact position.

16. The image forming apparatus according to claim 9, wherein the common resistor component is a current detection circuit, and wherein the control unit controls voltage supplied by the first power source and voltage supplied by the second power source based on current detected by the current detection circuit.

17. An image forming apparatus comprising:

first and second photosensitive members configured to be rotatably driven;

first and second charging units configured to respectively charge the first and the second photosensitive members at respective charging positions;

first and second developing members configured to cause toner to attach to the first and the second photosensitive members at respective developing positions;

first and second transfer units configured to transfer toner images formed on the first and the second photosensitive members onto a transfer target at respective transfer positions;

a third transfer unit configured to transfer the toner images transferred onto the transfer target onto a sheet;

a first power source configured to supply charging voltage to the first charging unit;

a second power source configured to supply predetermined voltage to at least one of the second charging unit, the second developing member, the second transfer unit, and the third transfer unit;

a separating mechanism configured to move the first developing member from a contact position where the first developing member is in contact with the first photosensitive member at the developing position to a separation position where the first developing member is separated from the first photosensitive member; and a control unit configured to control the separating mechanism;

wherein the first and the second power sources are grounded via a common resistor component, and wherein when the second power source in a state of supplying no voltage or supplying voltage lower than the predetermined voltage at a first timing starts supplying the predetermined voltage while the first power source is supplying the charging voltage, the control unit causes the separating mechanism to move the first developing member to the separation position before a second timing at which an area of the first photosensitive member that is at the charging position at the first timing reaches the developing position.

18. The image forming apparatus according to claim 17, wherein the image forming apparatus is capable of performing printing in a first mode of forming the toner image on the first photosensitive member without forming the toner image on the second photosensitive member and printing in a second mode of forming the toner images on the first and the second photosensitive members, and wherein the first timing is a timing before the printing in the second mode is started after the printing in the first mode is terminated.

19. An image forming apparatus comprising:

first and second photosensitive members configured to be rotatably driven;

first and second charging units configured to respectively charge the first and the second photosensitive members at respective charging positions;

first and second developing members configured to cause toner to attach to the first and the second photosensitive members at respective developing positions;

first and second transfer units configured to transfer toner images formed on the first and the second photosensitive members onto a transfer target at respective transfer positions;

a third transfer unit configured to transfer the toner images transferred onto the transfer target onto a sheet;

a first power source configured to supply transfer voltage to the first transfer unit;

a second power source configured to supply predetermined voltage to at least one of the second charging unit, the second developing member, the second transfer unit, and the third transfer unit;

a separating mechanism configured to move the first developing member from a contact position where the first developing member is in contact with the first photosensitive member at the developing position to a separation position where the first developing member is separated from the first photosensitive member; and a control unit configured to control the separating mechanism;

wherein the first and the second power sources are grounded via a common resistor component, and wherein when the second power source in a state of supplying no voltage or supplying voltage lower than the predetermined voltage at a first timing starts supplying the predetermined voltage while the first power source is supplying the transfer voltage, the control unit causes the separating mechanism to move the first developing member to the separation position before a second timing at which an area of the first photosensitive member that is at the transfer position at the first timing reaches the developing position.

20. The image forming apparatus according to claim 19, wherein the image forming apparatus is capable of performing printing in a first mode of forming the toner image on the first photosensitive member without forming the toner image on the second photosensitive member and printing in a second mode of forming the toner images on the first and the second photosensitive members, and wherein the first timing is a timing before the printing in the second mode is started after the printing in the first mode is terminated.

* * * * *